US012636752B2

(12) United States Patent
Kageyama et al.

(10) Patent No.: US 12,636,752 B2
(45) Date of Patent: May 26, 2026

(54) METHOD OF CONTROLLING POLISHING TOOL HOLDER, POLISHING TOOL HOLDER, AND POLISHING DEVICE

(71) Applicants: XEBEC TECHNOLOGY CO., LTD., Tokyo (JP); TAIMEI CHEMICALS CO., LTD., Nagano (JP)

(72) Inventors: Yoshiteru Kageyama, Tokyo (JP); Keisuke Fukushima, Tokyo (JP)

( * ) Notice: Subject to any disclaimer, the term of this patent is extended or adjusted under 35 U.S.C. 154(b) by 411 days.

(21) Appl. No.: 18/259,272

(22) PCT Filed: Dec. 25, 2020

(86) PCT No.: PCT/JP2020/048807

§ 371 (c)(1),
(2) Date: Jun. 25, 2023

(87) PCT Pub. No.: WO2022/137525

PCT Pub. Date: Jun. 30, 2022

(65) Prior Publication Data

US 2024/0082984 A1 Mar. 14, 2024

(51) Int. Cl.

| | |
|---|---|
| ***B24B 51/00*** | (2006.01) |
| ***B24B 29/00*** | (2006.01) |
| ***B24D 13/14*** | (2006.01) |

(52) U.S. Cl.
CPC ..... *B24B 51/00* (2013.01); *B24B 29/005* (2013.01); *B24D 13/14* (2013.01)

(58) Field of Classification Search
CPC ..... B24B 49/16; B24B 29/005; B24B 1/002
See application file for complete search history.

(56) References Cited

U.S. PATENT DOCUMENTS 4,768,308 A * 9/1988 Atkinson, III ..... B24B 13/043 451/5
5,044,125 A * 9/1991 Lambert, Jr. ..... B24B 49/16 451/72

(Continued)

FOREIGN PATENT DOCUMENTS

JP H11-70477 A 3/1999
JP 2005-169589 A 6/2005

(Continued)

OTHER PUBLICATIONS

WIPO, International Search Report for International Application No. PCT/JP2020/048807, Mar. 30, 2021.

(Continued)

*Primary Examiner* — Joel D Crandall
(74) *Attorney, Agent, or Firm* — IMAIZUMI IP LAW, PLLC; Toshikatsu Imaizumi

(57) ABSTRACT

A polishing tool holder (4) of a polishing device (1) has a shank (6), an attachment part (21) to which a polishing tool (3) is attached, a movement mechanism (22) including a motor (35) configured to move the attachment part (21) in an axial direction (X) of the shank (6), a load detector (23) configured to detect a load exerted on the polishing tool (3) attached to the attachment part (21), and a control unit (52) configured to control driving of the motor (35). The control unit (52) monitors an output from the load detector (23) and successively calculates the amount of change of the load, and performs a projection control operation of driving the motor (35) based on the load and the amount of change to advance or retract the polishing tool (3) attached to the attachment part (21).

18 Claims, 17 Drawing Sheets

(56) References Cited

U.S. PATENT DOCUMENTS

| | | | | | |
|---|---|---|---|---|---|
| 5,072,550 | A * | 12/1991 | Matsumoto | B23Q 15/12 | 451/61 |
| 5,193,953 | A * | 3/1993 | Jesinger | F16C 39/06 | 310/90.5 |
| 5,245,793 | A * | 9/1993 | Schmitz | B24B 35/00 | 451/49 |
| 5,711,697 | A * | 1/1998 | Taninaga | B24B 49/16 | 451/6 |
| 6,171,175 | B1 * | 1/2001 | Shaikh | B24D 13/10 | 451/28 |
| 2006/0211343 | A1 | 9/2006 | Yoshimura et al. | | |

FOREIGN PATENT DOCUMENTS

| | | | | |
|---|---|---|---|---|
| WO | 2016/021460 | A1 | 2/2016 | |
| WO | 2019/138595 | A1 | 7/2019 | |
| WO | WO-2019138471 | A1 * | 7/2019 | B24B 29/005 |

OTHER PUBLICATIONS

WIPO, Written Opinion for International Application No. PCT/JP2020/048807, Mar. 30, 2021.

* cited by examiner

METHOD OF CONTROLLING POLISHING TOOL HOLDER, POLISHING TOOL HOLDER, AND POLISHING DEVICE

FIELD

The present invention relates to a polishing tool holder that advances or retracts a polishing tool having a grinding element in the axial direction of a machine attachment part to adjust the depth of cut by the grinding element, and to a method of controlling the polishing tool holder. The present invention also relates to a polishing device including such a polishing tool holder and a polishing tool.

BACKGROUND

A polishing tool holder to which a polishing tool having a grinding element is removably attached is described in Patent Document 1. The polishing tool holder in this document includes a shank serving as a machine attachment part, an attachment part, and a support mechanism that supports the attachment part movably in the axial direction of the shank. The polishing tool holder also includes a movement mechanism including a drive source configured to move the attachment part in the axial direction, a load detector that detects a load exerted on a polishing tool attached to the attachment part, and a control unit that drives the drive source based on an output from the load detector to move the attachment part in the axial direction.

To machine a workpiece using the polishing tool holder, a polishing tool is attached to the attachment part to form a polishing device composed of the polishing tool and the polishing tool holder. The shank of the polishing device is then connected to a spindle of a machine tool, and the machine tool is operated. The grinding element is then brought into contact with a surface of a workpiece while the polishing device is moved by the machine tool along a predetermined machining path. The machining path is defined such that the distance between the spindle of the machine tool and a machining target surface of the workpiece is kept constant when the polishing tool faces the machining target surface.

When the grinding element wears during the machining operation, the tip of the grinding element retracts in a direction away from the surface of the workpiece. This reduces the load exerted on the polishing tool from the workpiece and then decreases the output (load) from the load detector. Here, when the output from the load detector becomes smaller than a predetermined load threshold range, the control unit performs a projection control operation of driving the drive source to advance the attachment part toward the workpiece. This operation causes the polishing tool to advance so that the grinding element is thrust toward the workpiece. The depth of cut of the workpiece by the grinding element thus can be ensured even when the grinding element wears during the machining operation.

When the polishing device comes too close to the machining target surface of the workpiece during the machining operation due to a dimensional deviation of the workpiece or the like, the load exerted on the polishing tool from the workpiece increases and then the output (load) from the load detector increases. Here, when the output from the load detector becomes larger than a predetermined load threshold range, the control unit performs a projection control operation of driving the drive source to retract the attachment part away from the workpiece. As a result, the polishing tool retracts and the grinding element retracts in a direction away from the workpiece. The depth of cut of the workpiece by the grinding element thus can be kept constant even when the polishing device comes too close to the workpiece during the machining operation.

CITATION LIST

Patent Literature

Patent Literature 1: WO2018/123456

SUMMARY

Technical Problem

The machining path along which the machine tool moves the polishing device may be set such that the polishing device starts in front of the workpiece, passes through the workpiece, and reaches deeper than the workpiece. In this case, while the polishing device passes through the workpiece, the grinding element polishes the machining target surface of the workpiece, so that wearing occurs on the grinding element. It is therefore necessary to perform the projection control operation to ensure the depth of cut of the workpiece by the grinding element when the output (load) from the load detector decreases. However, while the polishing device is positioned in front of the workpiece and after the polishing device reaches deeper than the workpiece, the grinding element is not in contact with the machining target surface of the workpiece. It is therefore unnecessary to perform the projection control operation even when the output from the load detector decreases.

Here, the machine tool that moves the polishing device along the machining path can grasp the position of the polishing device relative to the workpiece. However, the polishing tool holder connected to the machine tool is unable to grasp the position of the polishing device relative to the workpiece. Therefore, even when the polishing device is located in front of or deeper than the workpiece, the drive source is driven to move the polishing tool in the axial direction if the load output from the load detector decreases.

In view of the above problem, an object of the present invention is to provide a polishing tool holder and a polishing device that perform a projection control operation to move the polishing tool only when the polishing tool is in contact with a machining target surface of a workpiece. Another object is to propose a method of controlling such a polishing tool holder.

Solution to Problem

In order to solve the problem above, the present invention provides a method of controlling a polishing tool holder that includes a machine attachment part, an attachment part to which a polishing tool is attached, a movement mechanism including a drive source configured to move the attachment part in an axial direction of the machine attachment part, and a load detector configured to detect a load exerted on the polishing tool attached to the attachment part. The method includes attaching a polishing tool having a grinding element to the attachment part, connecting the machine attachment part to a spindle of a machine tool and operating the machine tool, monitoring an output from the load detector and calculating an amount of change of the load per unit time while the machine tool moves the polishing tool holder along a predetermined machining path, and performing a projection control operation of driving the drive source based on the load and the amount of change and moving the attachment part to advance or retract the polishing tool.

The polishing tool holder of the present invention is used in such that a polishing tool having a grinding element is attached to the attachment part, and the polishing tool and the polishing tool holder constitute a polishing device. Further, it is used such that the machine attachment part of the polishing device is connected to a spindle of a machine tool. According to the present invention, the output from the load detector is monitored and the amount of change in load per unit time is successively calculated while the polishing device is moved along a predetermined machining path by the machine tool, and the projection control operation is performed to drive the drive source based on the load and the amount of change to advance or retract the polishing tool. Here, the amount of change in load that changes while the polishing tool polishes the machining target surface of the workpiece during the polishing operation of the workpiece can be determined in advance by experiment or the like. The polishing tool holder therefore can determine whether the polishing tool is in contact with the machining target surface of the workpiece based on the amount of change in load. Thus, the projection control operation is performed based on the load and the amount of change in load, so that the polishing tool holder can perform the projection control operation to allow the polishing tool to stick out toward the workpiece only when the polishing tool is in contact with the machining target surface of the workpiece.

In the present invention, it is preferable that when the load is outside a preset load threshold range and the amount of change is smaller than a preset amount of change threshold, the projection control operation is allowed to be performed. In other words, the amount of change in load that changes while the polishing tool polishes the machining target surface of the workpiece during the polishing operation of the workpiece can be determined in advance by experiment or the like. Thus, the amount of change threshold is set in advance based on the amount of change obtained by experiment or the like, so that the polishing tool holder can determine that load fluctuations are caused not by wear of the grinding element when the amount of change becomes equal to or greater than the amount of change threshold. In other words, the polishing tool holder can determine that the polishing tool is polishing the machining target surface of the workpiece and that the load is changing due to wear of the grinding element by polishing when the amount of change is smaller than the amount of change threshold. Thus, the projection control operation is performed when the amount of change is smaller than the preset amount of change threshold and the load falls outside the preset load threshold range, so that the projection control operation can be performed when the polishing tool is in contact with the machining target surface of the workpiece and the load fluctuates due to wear of the grinding element.

In the present invention, the projection control operation may be stopped when the load is zero, and a state of not performing the projection control operation may be kept until the amount of change falls below a preset set amount of change. The state in which the load becomes zero is a state in which the load detector is not detecting a load exerted on the polishing tool. Thus, the state in which the load becomes zero is a state in which the polishing tool is not in contact with the workpiece. Accordingly, when the load becomes zero, the polishing tool holder can determine that the polishing device is positioned outside the machining target surface of the workpiece. Here, when the polishing device is positioned outside the machining target surface of the workpiece, wear does not occur in the grinding element. The polishing tool holder therefore sets a state of not performing the projection control operation. This can stop unnecessary projection control operation. Here, when the polishing device rides up on the machining target surface of the workpiece from the outside of the workpiece, the amount of change in load increases sharply as the polishing device comes into contact with the workpiece. Then, at a point of time when the polishing device completely rides up on the workpiece, the amount of change in load peaks out and then decreases. The amount of change is therefore a value close to zero at the point of time when the polishing device completely rides up on the workpiece. Accordingly, the set amount of change is set to a value, for example, close to zero, the projection control operation is stopped when the load is zero, the state of not performing the projection control operation is kept until the amount of change falls below the preset set amount of change, and the projection control operation is thereafter started, so that the projection control operation is not performed until the polishing device rides up on the workpiece, and the projection control operation can be performed after the polishing device rides up on the workpiece.

In the present invention, when the load is outside the load threshold range and the amount of change is within a predetermined amount of change threshold range, a state of not performing the projection control operation may be set, and when the load is outside the load threshold range and the amount of change is outside the amount of change threshold range, the projection control operation may be performed. When the polishing device descends from the machining target surface of the workpiece, the load exerted on the polishing tool from the workpiece sharply decreases while the polishing tool moves away from the workpiece. The amount of change in load therefore increases sharply. Here, the amount of change in load that sharply decreases when the polishing device descends from the workpiece can be determined in advance by experiment or the like. Thus, a predetermined range including the amount of change in load determined by testing or the like is set as the amount of change threshold range, so that the polishing tool holder can determine that the polishing device is descending from the machining target surface of the workpiece when the amount of change in load is within the amount of change threshold range. Thus, even when the load falls outside the load threshold range, the projection control operation is not performed if the amount of change is within the amount of change threshold range, so that unnecessary projection control operation can be stopped while the polishing device is descending from the machining target surface of the workpiece. On the other hand, if the amount of change is outside the amount of change threshold range when the load falls outside the load threshold range, the projection control operation is performed. Such a state occurs in a case where movement control to reduce the speed of moving the polishing device is performed on the machine tool side when the machine tool brings the polishing device down from the workpiece in order to polish the edge of the workpiece. The projection control operation is performed in such a case, so that the polishing tool can be advanced to ensure that the grinding element comes into contact with the edge of the workpiece. Here, when the polishing device completely descends from the workpiece, the load becomes zero. The projection control operation therefore stops at the point of time when the load becomes zero.

In the present invention, when the load falls outside the load threshold range and the amount of change becomes equal to or greater than the amount of change threshold, a state of not performing the projection control operation may be set, a duration time of a state in which the load is outside the load threshold range and the amount of change is equal to or greater than the amount of change threshold may be counted, the state of not performing the projection control operation may be kept until the duration time reaches a predetermined set time, and when the duration time exceeds the set time, the projection control operation may be resumed. In this way, in a case where the machining path has notches or depressions, the projection control operation can be avoided when the polishing device passes through the notches or depressions.

In the present invention, a plurality of the load threshold ranges associated with a length dimension of the grinding element in the axial direction may be retained in advance as the load threshold range. The attachment part having the polishing tool attached may be placed in an initial position to allow advance or retraction in the axial direction before the polishing tool holder is moved by the machine tool. Every time the attachment part is moved in the projection control operation, an amount of movement of the attachment part moving from the initial position to a side opposite to the machine attachment part may be calculated, based on an amount of driving of the drive source and a movement direction of the attachment part, and one load threshold range may be selected from among the load threshold ranges based on the amount of movement. In this way, the amount of movement of the attachment part moved from the initial position to the side opposite to the machine attachment part corresponds to the amount of wear of the grinding element. Thus, one load threshold range is selected from among a plurality of load threshold ranges based on the amount of movement (the amount of wear of the grinding element), so that the cutting ability of the grinding element can be easily kept constant.

In the present invention, a first load threshold range and a second load threshold range different from the first load threshold range may be retained in advance as the load threshold range. The first load threshold range may be set as the load threshold range, a number of times the load becomes zero may be counted, and when the number of times reaches a predetermined set number of times, the load threshold range may be set to the second load threshold range. In this way, in a case where the polishing device moving along the machining path repeatedly rides up on and descends from the machining target surface of the workpiece, the load threshold range can be set to the first load threshold range until the number of times the polishing device descends from the machining target surface reaches the set number of times, and thereafter, the load threshold range can be set to the second load threshold range. With this configuration, the depth of cut of the workpiece by the grinding element can be adjusted in the middle of the machining path.

In the present invention, a storage unit may be provided. The polishing tool holder may be moved along a predetermined training path by the machine tool, an output from the load detector may be monitored and an amount of change of the load per unit time may be successively calculated, the load threshold range may be set based on the load, the amount of change threshold may be set based on the amount of change, and the set load threshold range and the set amount of change threshold may be stored and retained in the storage unit. When the machine tool moves the polishing tool holder along the machining path, the storage unit may be referred to, and the load threshold range and the amount of change threshold may be acquired. In this way, the load threshold range and the amount of change threshold can be easily set.

In the present invention, the polishing tool may have a grinding element with a length direction oriented in the axial direction and a grinding element holder holding one end in the axial direction of the grinding element. The grinding element holder may be attached to the attachment part.

A polishing tool holder of the present invention includes: a machine attachment part; an attachment part to which a polishing tool having a grinding element is attached; a movement mechanism including a drive source configured to move the attachment part in an axial direction of the machine attachment part; a load detector configured to detect a load exerted on the polishing tool attached to the attachment part; and a control unit configured to monitor an output from the load detector and successively calculate an amount of change of the load per unit time, and perform a projection control operation of driving the drive source based on the load and the amount of change and moving the attachment part to advance or retract the polishing tool.

The polishing tool holder of the present invention is used in such that a polishing tool having a grinding element is attached to the attachment part, and the polishing tool and the polishing tool holder constitute a polishing device. According to the present invention, the output from the load detector is monitored and the amount of change in load per unit time is successively calculated while the polishing device is moved along a predetermined machining path by the machine tool, and the projection control operation is performed to drive the drive source based on the load and the amount of change to advance or retract the polishing tool. Here, the polishing tool holder can determine whether the polishing tool is in contact with the machining target surface of the workpiece based on the amount of change in load. Thus, the projection control operation is performed based on the load and the amount of change in load, so that the polishing tool holder can perform the projection control operation to allow the polishing tool to stick out toward the workpiece only when the polishing tool is in contact with the machining target surface of the workpiece.

In the present invention, when the load is outside a preset load threshold range and the amount of change is smaller than a preset amount of change threshold, the control unit may perform the projection control operation. In this way, the polishing tool holder can perform the projection control operation when the polishing tool is polishing the machining target surface of the workpiece and the load is changing due to wear of the grinding element by polishing.

In the present invention, the control unit may stop the projection control operation when the load is zero, and may keep a state of not performing the projection control operation until the amount of change falls below a preset set amount of change. In this way, the polishing tool holder can set the state of not performing the projection control operation while the polishing device is positioned outside the machining target surface of the workpiece and until the polishing device rides up on the workpiece from the outside of the workpiece.

In the present invention, when the load is outside the load threshold range and the amount of change is within a predetermined amount of change threshold range, the control unit may set a state of not performing the projection control operation, and when the load is outside the load threshold range and the amount of change is outside the amount of change threshold range, the control unit may perform the projection control operation. In this way, the polishing tool holder can set the state of not performing the projection control operation when the polishing device descends from the machining target surface of the workpiece. If the machine tool reduces the speed of moving the polishing tool holder, for example, when the polishing device descends from the machining target surface of the workpiece, the polishing tool holder can perform the projection control operation to ensure that the edge of the workpiece is polished by the grinding element.

In the present invention, the polishing tool holder may further include a timer. When the load falls outside the load threshold range and the amount of change becomes equal to or greater than the amount of change threshold, the control unit may set a state of not performing the projection control operation, drive the timer to count a duration time of a state in which the load is outside the load threshold range and the amount of change is equal to or greater than the amount of change threshold, keep the state of not performing the projection control operation until the duration time reaches a predetermined set time, and resume the projection control operation when the duration time exceeds the set time. In this way, in a case where the workpiece has a plurality of small notches or a plurality of small depressions on the machining path through which the polishing device passes, the projection control operation can be avoided in the section in which the polishing device passes through these notches or depressions.

In the present invention, the polishing tool holder may further include a load threshold storage unit configured to store and retain a plurality of load threshold ranges associated with a length dimension of the grinding element in the axial direction as the load threshold range. The control unit may include an initial operation control unit configured to place the attachment part in an initial position to allow advance or retraction in the axial direction, and a load threshold range resetting unit configured to calculate an amount of movement of the attachment part moving from the initial position to a side opposite to the machine attachment part, based on an amount of driving of the drive source and a movement direction of the attachment part, every time the attachment part is moved in the projection control operation, and refer to the load threshold storage unit based on the amount of movement and select one load threshold range from among the load threshold ranges. In this way, the cutting ability of the grinding element can be easily kept constant.

In the present invention, the polishing tool holder may further include a load threshold storage unit configured to store and retain a first load threshold range and a second load threshold range different from the first load threshold range as the load threshold range. The control unit may include a counting unit configured to count a number of times the load becomes zero, and a load threshold range resetting unit configured to set the first load threshold range as the load threshold range until the number of times reaches a predetermined set number of times, and set the load threshold range to the second load threshold range when the number of times reaches the set number of times. In this way, in a case where the polishing device moving along the machining path repeatedly rides up on and descends from the machining target surface of the workpiece, the load threshold range can be set to the first load threshold range until the number of times the polishing device descends from the machining target surface reaches the set number of times, and thereafter, the load threshold range can be set to the second load threshold range. With this configuration, the depth of cut of the workpiece by the grinding element can be adjusted in the middle of the machining path.

In the present invention, the control unit may include an operation mode switching unit configured to switch an operation mode of the control unit between a normal operation mode and a learning operation mode, and a training data setting unit configured to monitor an output from the load detector and successively calculate an amount of change of the load per unit time, set the load threshold range based on the load and set the amount of change threshold based on the amount of change, and store and retain the set load threshold range and the set amount of change threshold in the storage unit, in the learning operation mode. The control unit may refer to the storage unit and acquire the load threshold range and the amount of change threshold from the storage unit in the normal operation mode. In this way, the load threshold range and the amount of change threshold can be easily set.

A polishing device of the present invention includes: the polishing tool holder described above; and a polishing tool removably attached to an attachment part of the polishing tool holder. The polishing tool includes a grinding element with a length direction oriented in the axial direction and a grinding element holder holding one end in the axial direction of the grinding element. The grinding element holder is attached to the attachment part.

Advantageous Effects of Invention

The polishing tool holder of the present invention performs the projection control operation based on the load and the amount of change in load. With this configuration, the polishing device can perform the projection control operation to move the polishing tool only when the polishing tool is in contact with the polishing target surface of the workpiece.

DESCRIPTION OF EMBODIMENTS

Figure 1:
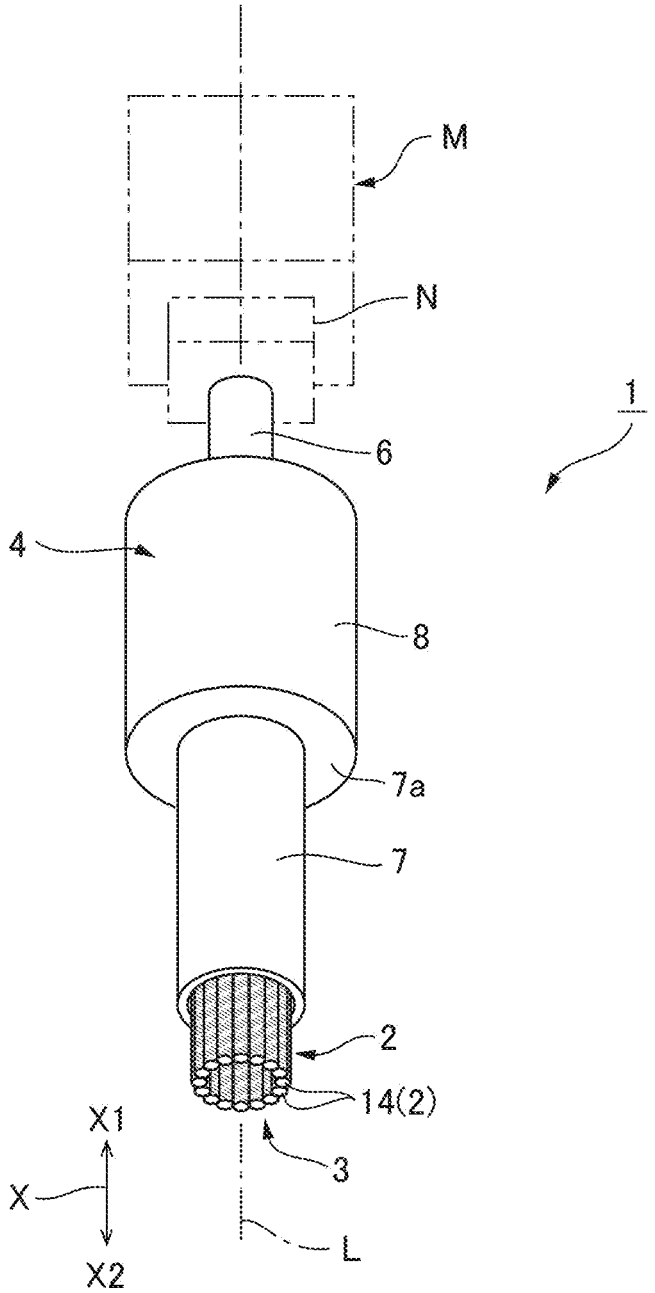
FIG. 1 is a perspective view of a polishing device.
Figure 2:
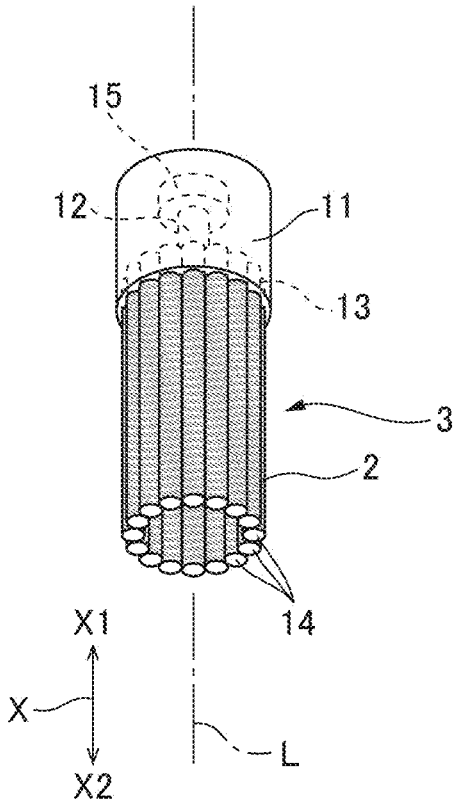
FIG. 2 is a perspective view of a polishing tool.
Figure 3:
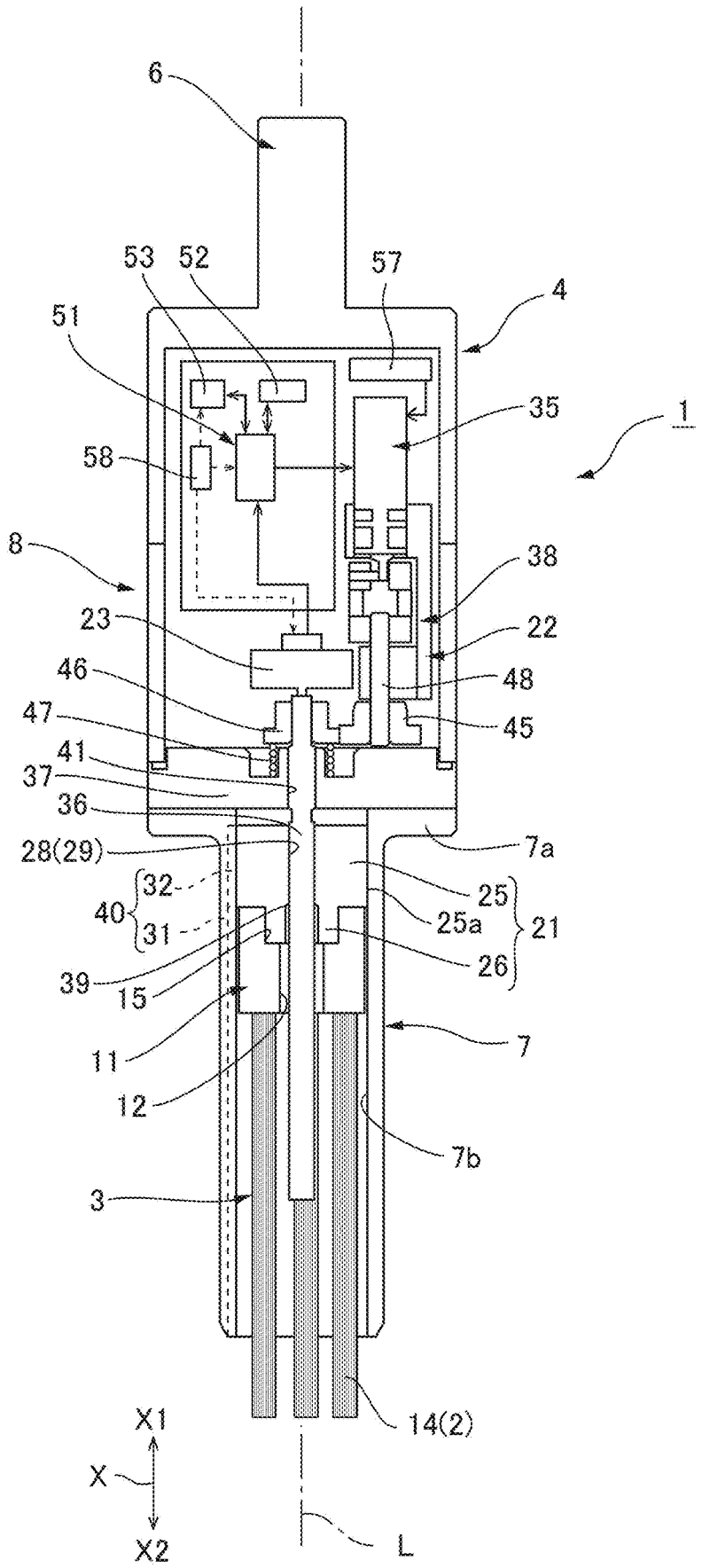
FIG. 3 is an illustration of an overall structure of the polishing device.
Figure 4:
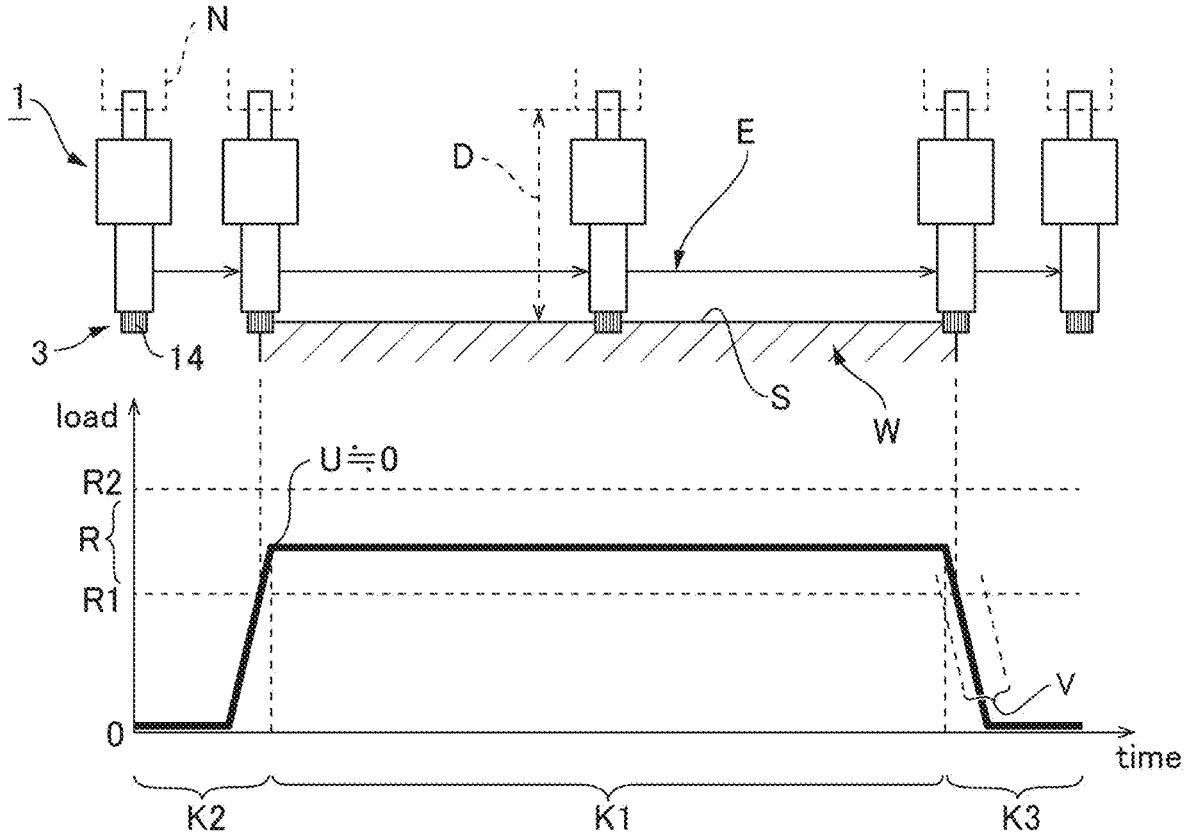
FIG. 4 is an illustration of a load exerted on the polishing tool while the polishing device moves along a machining path.

A polishing tool holder that is an embodiment of the present invention will be described below with reference to the drawings. FIG. 1 is an external perspective view of a polishing device to which the present invention is applied. FIG. 2 is a perspective view of a polishing tool. FIG. 3 is an illustration of an overall structure of the polishing device in FIG. 1. In FIG. 3, the polishing device cut along the axis of a machine attachment part is illustrated. FIG. 4 is an illustration of a load exerted on the polishing tool while the polishing device is moved along a machining path. The upper section of FIG. 4 illustrates the positional relation between the polishing device and a workpiece. The lower section of FIG. 4 is a graph of the load exerted on the polishing tool from the workpiece.

(Polishing Device)

As illustrated in FIG. 1, a polishing device 1 includes a polishing tool 3 and a polishing tool holder 4 holding the polishing tool 3. The polishing tool holder 4 includes a shank 6 (machine attachment part) and a sleeve 7 coaxial to the shank 6. Between the shank 6 and the sleeve 7, a large diameter portion 8 is provided, which has a larger diameter than the shank 6 and the sleeve 7. The polishing tool 3 is held in the polishing tool holder 4 such that the ends of wire-shaped grinding elements 2 (grinding element) protrude from the sleeve 7. In the following description, a direction along the axis L of the shank 6 is denoted as the axial direction X. In the axial direction X, the side of the shank 6 is a back side X1 of the polishing tool holder 4, and the side opposite to the shank 6 is a front side X2 of the polishing tool holder 4.

(Polishing Tool)

As illustrated in FIG. 2, the polishing tool 3 has a plurality of wire-shaped grinding elements 2 disposed side by side and a grinding element holder 11 holding one end of each of these wire-shaped grinding elements 2. Each of the wire-shaped grinding elements 2 includes an assembly of inorganic filaments such as alumina filaments, and a resin filling the assembly of filaments and cured. The wire-shaped grinding elements 2 have elasticity to flex in a direction intersecting the axis L. A plurality of wire-shaped grinding elements 2 are divided into bundles.

The grinding element holder 11 is an annular member having a holder through hole 12 extending in the axial direction X at the center. The grinding element holder 11 has a plurality of grinding element-holding holes 13 on its front end surface. Each of the grinding element-holding holes 13 is circular. A plurality of grinding element-holding holes 13 are provided at equiangular intervals around the axis L to surround the holder through hole 12. As illustrated in FIG. 3, the grinding element holder 11 has a recess surrounding the holder through hole 12 at its back end surface. The recess is a polishing tool-side joint portion 15 for removably attaching the polishing tool 3 to the polishing tool holder 4.

A plurality of wire-shaped grinding elements 2 are bundled together to form a grinding element bundle 14 when held in the grinding element-holding hole 13. The back end of each grinding element bundle 14 is inserted in the grinding element-holding hole 13. The grinding element bundles 14 are fixed to the grinding element holder 11 by adhesive filled in the grinding element-holding holes 13.

(Polishing Tool Holder)

As illustrated in FIG. 3, the polishing tool holder 4 has the shank 6, an attachment part 21 to which the polishing tool 3 is removably attached, a movement mechanism 22 that moves the attachment part 21 in the axial direction X, and a load detector 23 that detects a load exerted on the polishing tool 3 attached to the attachment part 21. The shank 6 protrudes from the large diameter portion 8 to the back side X1.

The attachment part 21 is an annular member. The attachment part 21 is arranged in the sleeve 7 so as to be movable in the axial direction X. The attachment part 21 includes a disc portion 25 having an annular facing surface 25*a* facing an inner peripheral surface 7*b* of the sleeve 7 with a slight gap, and a protrusion 26 protruding from the center of the disc portion 25 to the front side X2. The protrusion 26 has a shape fitted in the polishing tool-side joint portion 15 of the polishing tool 3. The polishing tool 3 has the polishing tool-side joint portion 15 fitted to the protrusion 26 of the attachment part 21 and thereby is removably attached to the polishing tool holder 4. In a state in which the polishing tool 3 is coupled to the attachment part 21, the polishing tool 3 and the attachment part 21 are integrated such that they are unable to rotate relative to each other around the axis L. A female thread 29 is provided on the inner peripheral surface of a central hole 28 of the attachment part 21.

The movement mechanism 22 includes a shaft member 36 extending in the axial direction X, a support member 37 supporting the shaft member 36 movably in the axial direction X and rotatably around the axis L, a motor 35 serving as a drive source, and a drive force-transmitting mechanism 38 for transmitting the rotation of the motor 35 to the shaft member 36. The movement mechanism 22 also includes a rotation restricting mechanism 40 that restricts co-rotation of the attachment part 21 and the shaft member 36.

The shaft member 36 is arranged on the axis L. The shaft member 36 has a male thread 39 on its outer peripheral surface to be screwed into the female thread 29 of the attachment part 21. The support member 37 is a ring-shaped member extending in a direction orthogonal to the axis L and has a through hole 41 extending in the axis L direction at the center. A flange 7*a* extending from the back end portion of the sleeve 7 toward the outer periphery is fixed to the front surface of the support member 37. The support member 37 and the flange of the sleeve 7 constitute an end wall on the front side X2 of the large diameter portion 8. The shaft member 36 penetrates through the through hole 41 in the support member 37. The back end portion of the shaft member 36 penetrating through the through hole 41 protrudes into the interior of the large diameter portion 8. The front portion of the shaft member 36 penetrating through the through hole 41 extends inside the sleeve 7 coaxially with the sleeve 7.

The motor 35 and the drive force-transmitting mechanism 38 are arranged in the interior of the large diameter portion 8 on the back side X1 of the support member 37. The motor 35 is a stepping motor. The drive force-transmitting mechanism 38 includes a final gear 45 to which the drive force of the motor 35 is transmitted, an output gear 46 coaxially fixed to the shaft member 36 and meshing with the final gear 45, and a biasing member 47 biasing the output gear 46 toward the support member 37. The final gear 45 is rotatably supported by a support shaft 48 extending from the support member 37 to the back side X1. The support shaft 48 is parallel to the shaft member 36. The final gear 45 and the output gear 46 fixed to the shaft member 36 therefore rotate around the rotation axes parallel to each other. The output gear 46 abuts on the support member 37 from the back side X1 by the biasing force of the biasing member 47.

When the shaft member 36 moves to the back side X1, the output gear 46 fixed to the shaft member 36 moves to the back side X1 against the biasing force of the biasing member 47. Thus, when the shaft member 36 is moving to the back side X1, the shaft member 36 is moving against the biasing force of the biasing member 47. When the shaft member 36 moves to the back side X1, the output gear 46 is spaced apart from the support member 37 to the back side X1.

Here, the rotation axes of the final gear 45 and the shaft member 36 to which the output gear 46 is fixed are parallel. Thus, even when the output gear 46 moves in the axial direction X, the meshed state of the output gear 46 and the final gear 45 is kept. With this configuration, the rotation of the motor 35 is always transmitted to the output gear 46 through the drive force-transmitting mechanism 38. When the drive force of the motor 35 is transmitted to the output gear 46, the shaft member 36 rotates around the axis L.

The rotation restricting mechanism 40 includes a groove 31 provided on the inner peripheral surface 7*b* of the sleeve 7, and a protrusion 32 provided at a circumferential portion of the facing surface 25*a* of the attachment part 21. The groove 31 extends in the axial direction X on the inner peripheral surface 7*b* of the sleeve 7. The protrusion 32 extends with a constant width in the axial direction X. Here, the attachment part 21 is arranged in the sleeve 7 with the protrusion 32 inserted in the groove 31 of the sleeve 7. The rotation of the attachment part 21 is therefore prevented when the shaft member 36 rotates.

The load detector 23 is a pressure sensor. The load detector 23 is arranged on the back side X1 of the support member 37 in the inside of the large diameter portion 8. The load detector 23 is in contact with the shaft member 36 from the back side X1 to detect a pressure in the axial direction X exerted on the shaft member 36. To machine a workpiece W, the shank 6 of the polishing device 1 is connected to a spindle N of a machine tool M, and then the machine tool M is operated. The machine tool M then moves the polishing device 1 along a machining path programmed in advance.

As illustrated in FIG. 4, a machining path E along which the machine tool M moves the polishing device 1 may be set such that the polishing device 1 starts in front of the workpiece W, passes through the workpiece W, and reaches deeper than the workpiece W. The machining path E is set such that the distance D between the spindle N and a machining target surface S of the workpiece W is kept constant when the polishing device 1 passes through the workpiece W. When the polishing device 1 passes through the workpiece W, the tip portion of the grinding element bundle 14 comes into contact with the machining target surface S.

(Control System)

Figure 5:
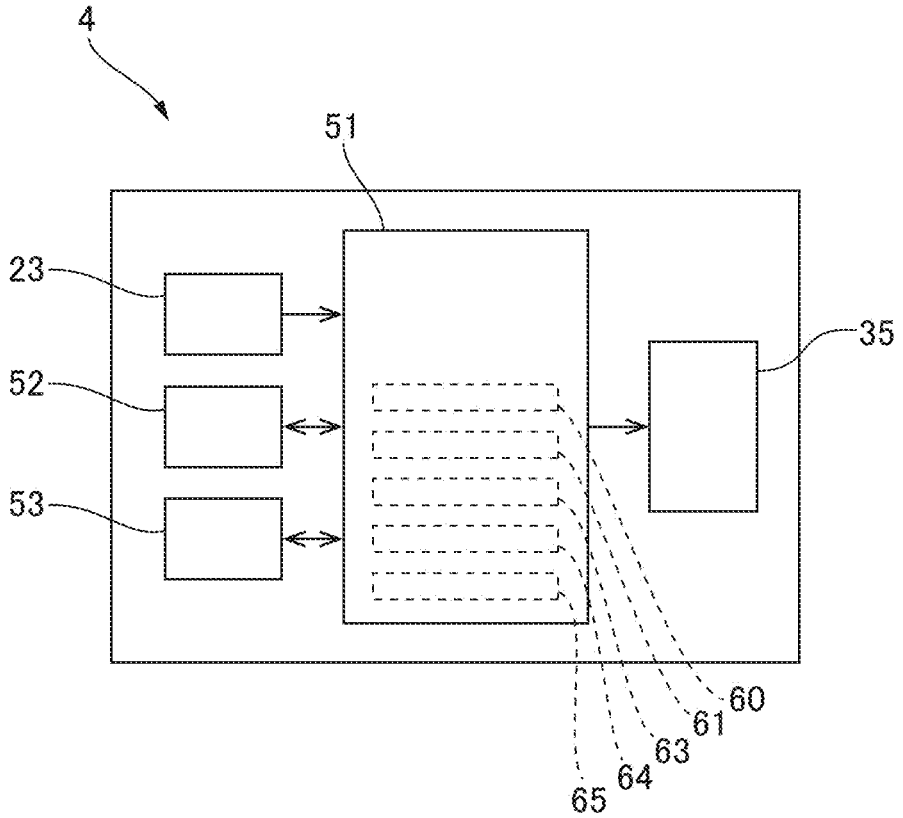
FIG. 5 is a schematic block diagram illustrating a control system of a polishing tool holder.
Figure 6:
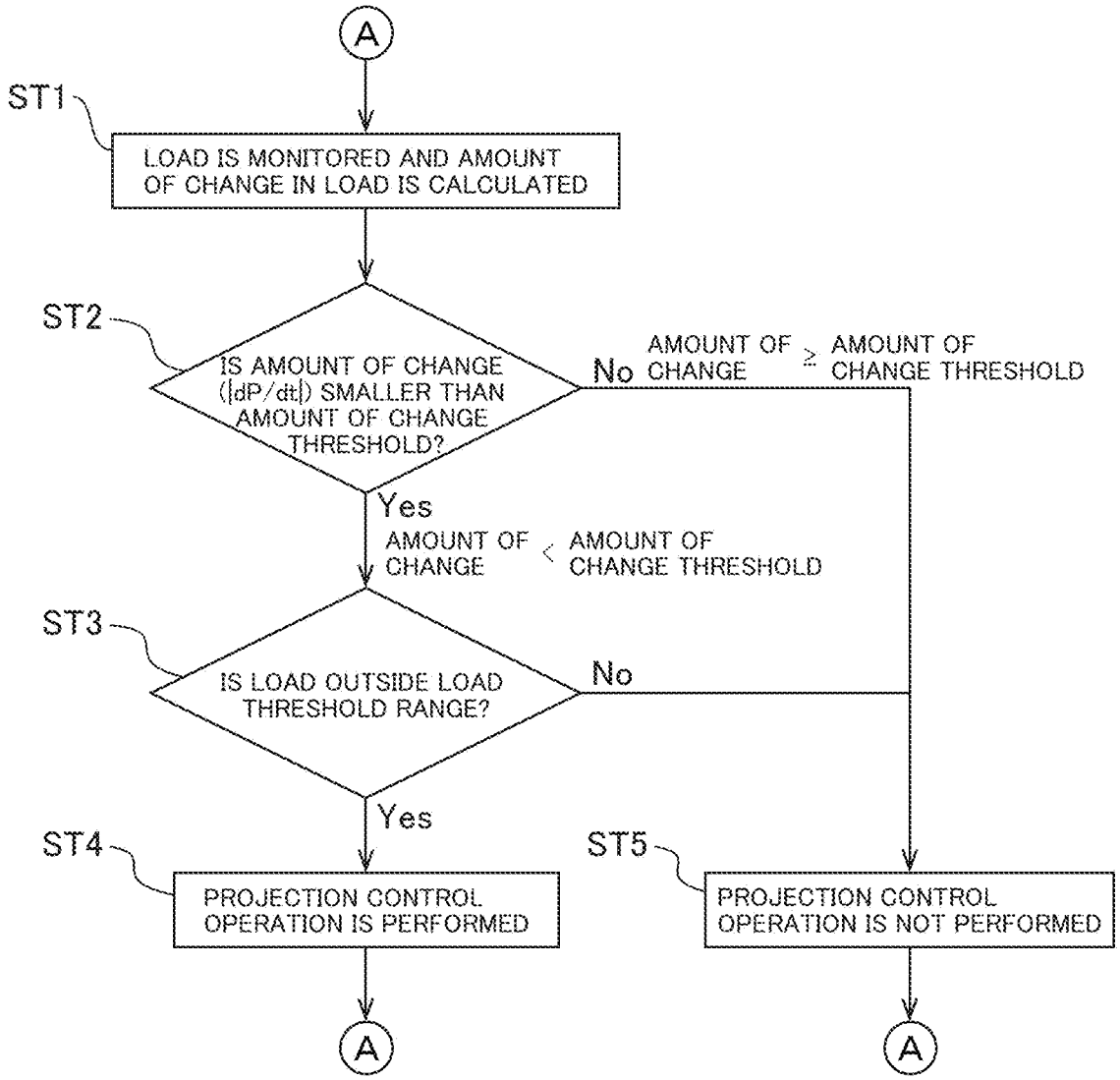
FIG. 6 is a flowchart of a projection control operation performed when the polishing device passes through a workpiece.
Figure 7:
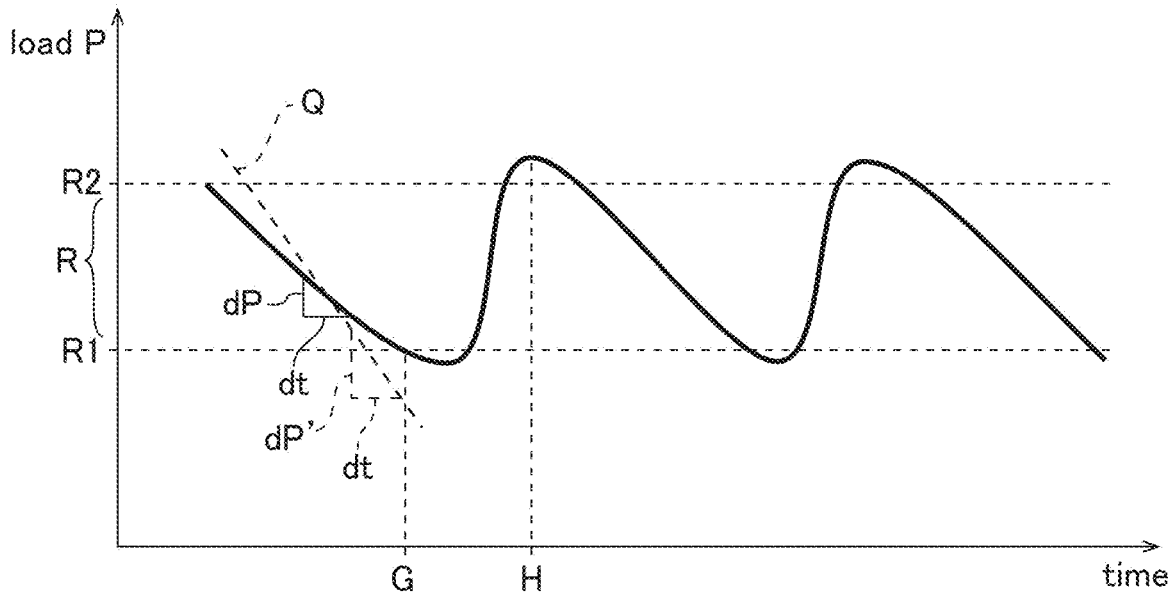
FIG. 7 is a graph illustrating the load and the amount of change when the polishing device performs the projection control operation.
Figure 8:
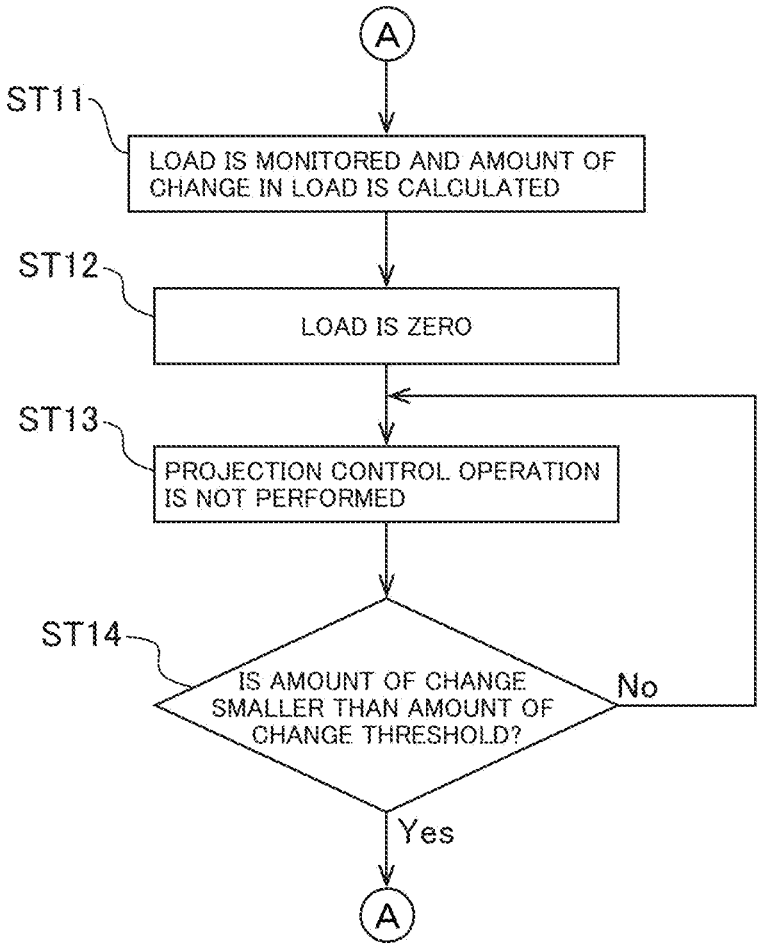
FIG. 8 is a flowchart of the projection control operation performed when the polishing device rides up on the workpiece.
Figure 9:
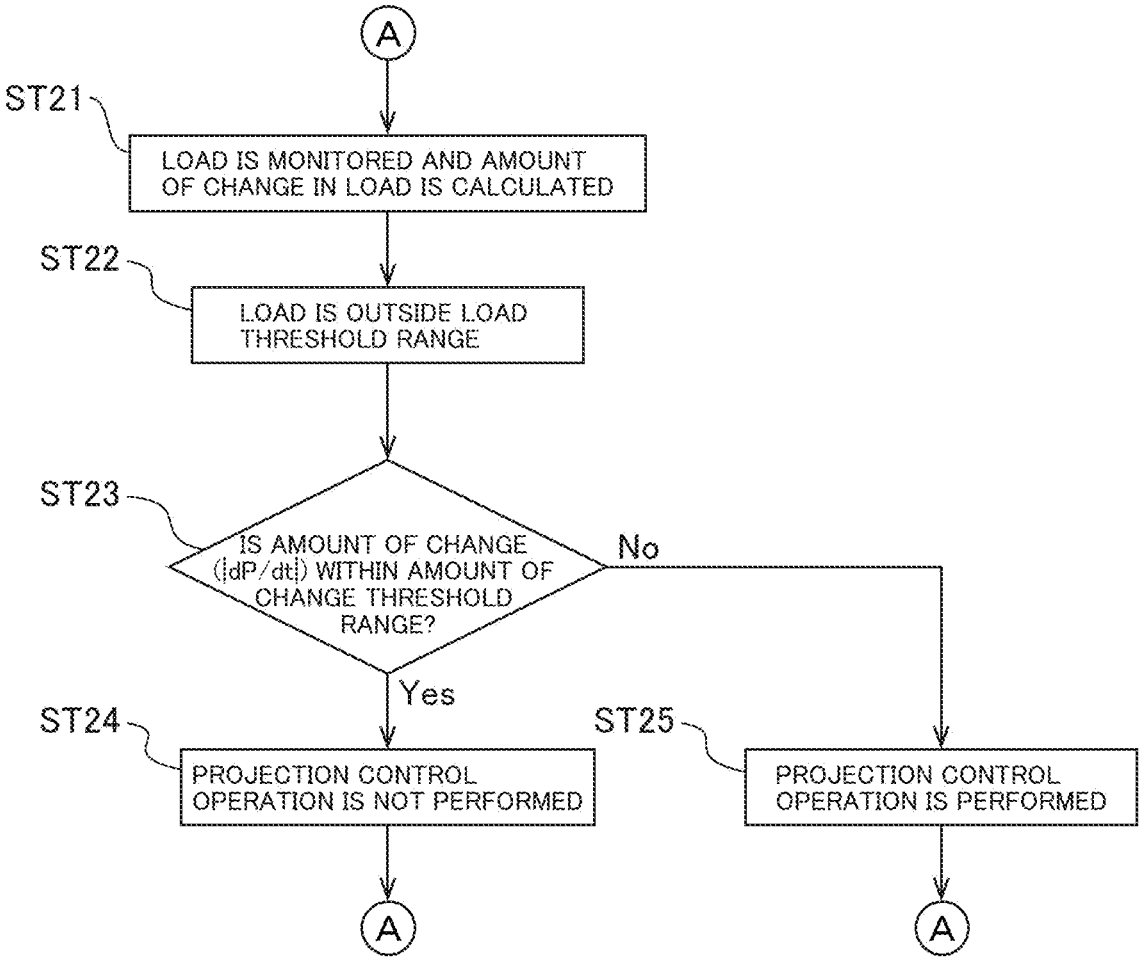
FIG. 9 is a flowchart of the projection control operation performed when the polishing device descends from the workpiece.
Figure 10:
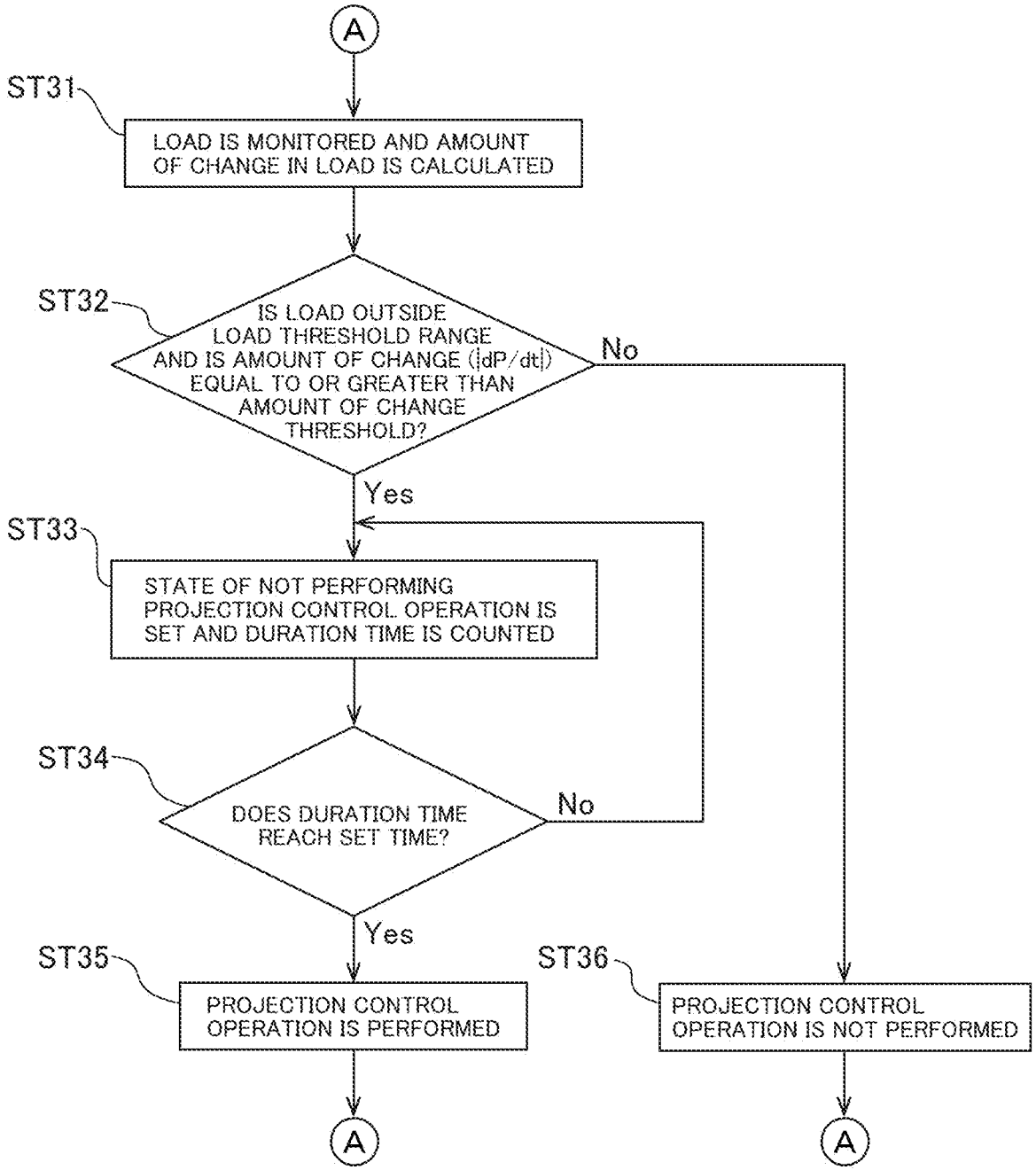
FIG. 10 is a flowchart of the projection control operation in a case where the machining path has notches.
Figure 11:
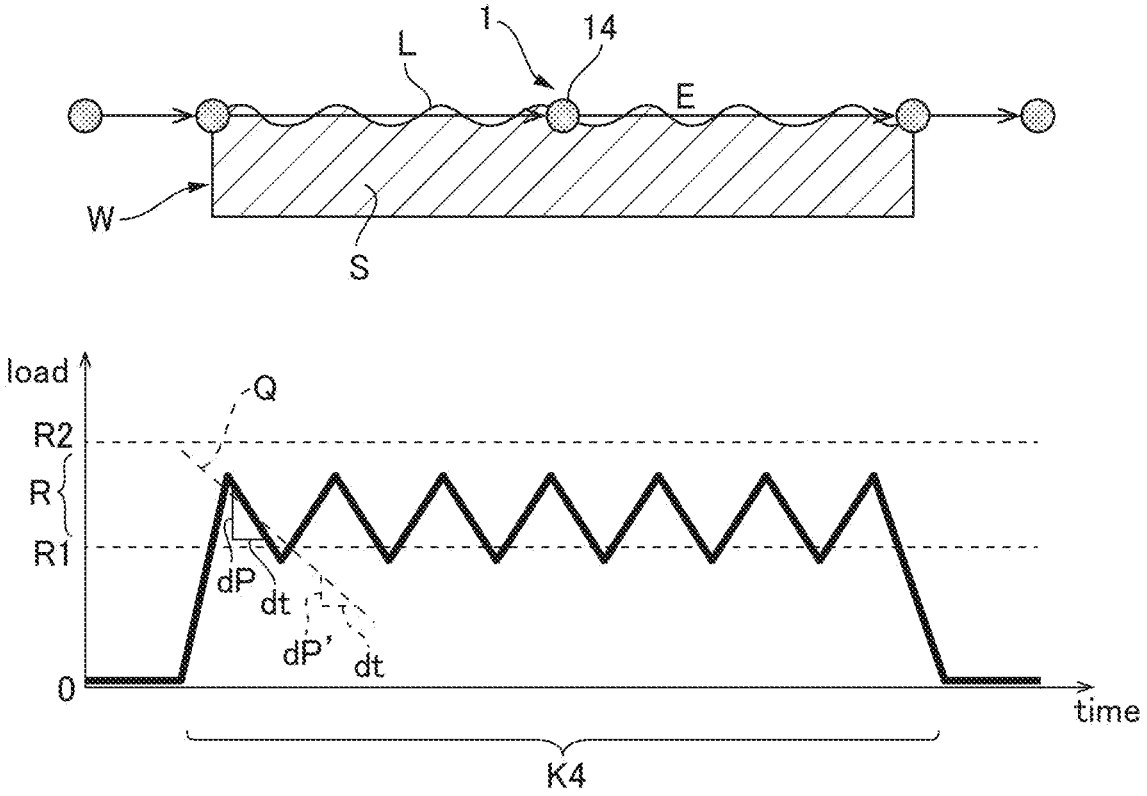
FIG. 11 is an illustration of the load and the amount of change in a case where the machining path has notches.

FIG. 5 is a schematic block diagram illustrating a control system of the polishing tool holder 4. FIG. 6 is a flowchart of a projection control operation performed when the polishing device 1 passes through the workpiece W. FIG. 7 is a graph illustrating the load and the amount of change when the projection control operation is performed. FIG. 8 is a flowchart of the projection control operation performed when the polishing device 1 rides up on the workpiece W. FIG. 9 is a flowchart of the projection control operation performed when the polishing device 1 descends from the workpiece W. FIG. 10 is a flowchart of the projection control operation in a case where the machining path has notches. FIG. 11 is an illustration of the load in a case where the machining path has notches. The upper section of FIG. 11 illustrates the positional relation between the polishing device and the workpiece as viewed from the axis L direction. The lower section of FIG. 11 is a graph of the load exerted on the polishing tool from the workpiece.

As illustrated in FIG. 5, the control system of the polishing tool holder 4 includes a control unit 51 including a CPU, a storage unit 52 connected to the control unit 51, and a timer 53. The load detector 23 is connected to the input side of the control unit 51. The motor 35 is connected to the output side of the control unit 51. As illustrated in FIG. 3, the polishing tool holder 4 includes a motor battery 57 that supplies power to the motor 35 and a control battery 58 that supplies power to the control unit 51 and the timer 53. The motor battery 57 and the control battery 58 can be externally charged through a cable.

Here, while the polishing device 1 moves along the machining path E, the control unit 51 monitors the output (load) from the load detector 23 and successively calculates the amount of change in load per predetermined unit time.

More specifically, the control unit 51 acquires the load output from the load detector 23 in certain cycles and also acquires the amount of change in load per unit time from three loads acquired sequentially in chronological order. Here, the load can be acquired at intervals of 0.001 seconds to 1 second. The unit time for calculating the amount of change in load is a period of time three times the interval at which the load is acquired. The calculation of the amount of change in load is performed at the same interval as the interval at which the load is acquired. The amount of change is the absolute value of the range in which the load (P) increases or decreases per unit time, and can be written as the following expression where the unit time is dt and the range in which the load increases or decreases is dP.

$$|dP/dt|$$

The control unit 51 performs a projection control operation to adjust the depth of cut of the workpiece W by the grinding element bundle 14 based on the successively acquired load and amount of change.

More specifically, as illustrated in FIG. 6, the control unit 51 monitors the load and successively calculates the amount of change (step ST1). If the amount of change is smaller than a preset amount of change threshold Q (Yes at step ST2) and the load falls outside a preset load threshold range R (Yes at step ST3), the projection control operation is performed to control the driving of the motor 35 to move the attachment part 21 and advance or retract the polishing tool 3 (step ST4). On the other hand, if the amount of change becomes equal to or greater than the amount of change threshold Q (NO at step ST2), the control unit 51 does not perform the projection control operation (step ST5). Even when the amount of change is smaller than the amount of change threshold Q (Yes at step ST2), if the load is within the load threshold range R (NO at step ST3), the control unit 51 does not perform the projection control operation (step ST5). Such control is performed in a section K1 (see FIG. 4) in which the polishing device 1 passes through the machining target surface S of the workpiece W.

Here, a standard amount of change in load that changes while the polishing tool 3 polishes the machining target surface S of the workpiece W during the polishing operation of the workpiece W can be determined in advance by experiment or the like. Thus, the amount of change threshold Q is set in advance based on the amount of change obtained by experiment or the like and stored and retained in the storage unit 52, so that the control unit 51 can refer to the storage unit 52 and determine that load fluctuations are caused not by wear of the grinding element bundle 14 but by some other factor when the amount of change becomes equal to or greater than the amount of change threshold Q. In other words, the amount of change threshold Q is set in advance based on experiment or the like, so that the control unit 51 can determine that the polishing tool 3 is polishing the machining target surface S of the workpiece W and that the load is changing due to wear of the grinding element bundle 14 by polishing when the amount of change is smaller than the amount of change threshold Q.

In a state in which the polishing tool 3 is polishing the machining target surface S of the workpiece W, the range of load under which the polishing tool 3 polishes the machining target surface S of the workpiece W with a desired depth of cut can be determined in advance by experiment or the like. Thus, a first threshold R1 which is the lower limit of load suitable for polishing the workpiece W and a second threshold R2 which is the upper limit of load suitable for polishing are determined based on experimental results, and the load threshold range R is set between the first threshold R1 and the second threshold R2 and stored and retained in the storage unit 52, so that the control unit 51 can refer to the storage unit 52 and determine that the depth of cut of the workpiece W by the grinding element bundle 14 falls below the appropriate range if the load falls outside the load threshold range R due to wear of the grinding element bundle 14 or the like. When the load falls outside the load threshold range R, the control unit 51 can determine that the depth of cut of the workpiece W by the grinding element bundle 14 exceeds the appropriate range. The first threshold R1 and the second threshold R2 are both values greater than zero.

Referring to FIG. 7, the projection control operation will now be described. FIG. 7 is a graph of the relation between the output from the load detector 23 and the projection control operation. A point of time G in the graph in FIG. 7 is the point of time at which the output from the motor 35 becomes lower than the predetermined first threshold R1 when the amount of change (|dP/dt|) is smaller than the amount of change threshold Q (|dP'/dt|). At the point of time G, the control unit 51 drives the motor 35 in a predetermined rotation direction to move the attachment part 21 to the front side X2. Further, the control unit 51 monitors the output from the motor 35 when driving the motor 35 to move the attachment part 21, and when the output reaches the second threshold R2, the control unit 51 stops driving the motor 35 based on the monitored output to stop moving the attachment part 21.

Next, a point of time H in the graph in FIG. 7 is the point of time at which the output from the motor 35 becomes higher than the predetermined second threshold R2 when the amount of change (|dP/dt|) is smaller than the amount of change threshold Q. At the point of time H, the control unit 51 drives the motor 35 in the direction opposite to the predetermined rotation direction to move the attachment part 21 to the back side X1. Further, the control unit 51 monitors the output from the motor 35 when driving the motor 35 to move the attachment part 21, and when the output falls below the second threshold R2, the control unit 51 stops driving the motor 35 based on the monitored output to stop moving the attachment part 21. In this way, the polishing device 1 performs the projection control operation to keep the depth of cut of the workpiece W by the grinding element bundle 14 within an appropriate range when the polishing tool 3 is polishing the machining target surface S of the workpiece W and the load is changing due to wear of the grinding element bundle 14 by polishing.

As illustrated in FIG. 8, the control unit 51 monitors the load and successively calculates the amount of change (step ST11), stops the projection control operation when the load is zero (step ST12, step ST13), and keeps a state of not performing the projection control operation until the amount of change falls below a preset set amount of change U (No at step ST14, step ST13). As illustrated in FIG. 4, such control is performed in a section K2 until the polishing device 1 that has been positioned outside the workpiece W rides up on the machining target surface S of the workpiece W.

In other words, as illustrated in FIG. 4, when the polishing device 1 is positioned outside the machining target surface S of the workpiece W, the polishing tool 3 is not in contact with the workpiece W. The load exerted on the polishing tool 3 is therefore zero. Accordingly, when the load is zero, the control unit 51 can determine that the polishing device 1 is positioned outside the machining target surface S of the workpiece W. Here, when the polishing device 1 is positioned outside the machining target surface S of the workpiece W, wear does not occur in the grinding element bundle 14. The control unit 51 therefore sets a state of not performing the projection control operation.

Subsequently, when the polishing device 1 rides up on the machining target surface S of the workpiece W from the outside of the workpiece W, as illustrated in FIG. 4, the amount of change in load increases sharply as the polishing device 1 (grinding element bundle 14) comes into contact with the workpiece W. Then, at a point of time J at which the polishing device 1 completely rides up on the workpiece W, the amount of change in load peaks out and then decreases. The amount of change is therefore close to zero when the polishing device 1 completely rides up on the workpiece W. Accordingly, the set amount of change U is set to a value, for example, close to zero, and the control unit 51 stops the projection control operation when the load is zero and keeps the state of not performing the projection control operation until the amount of change falls below the preset set amount of change U, so that the projection control operation is not performed until the polishing device 1 rides up on the workpiece W, and the projection control operation can be performed after the polishing device 1 rides up on the workpiece W.

Further, as illustrated in FIG. 9, the control unit 51 monitors the load and successively calculates the amount of change (step ST21), and when the load is outside the load threshold range R (step ST22) and the amount of change is within a predetermined amount of change threshold range V (Yes at step ST23), the control unit 51 does not perform the projection control operation (step ST23). On the other hand, the control unit 51 performs the projection control operation when the load is outside the load threshold range R (No at step ST22) and the amount of change is outside the amount of change threshold range V (step ST24). As illustrated in FIG. 4, such control is performed when the polishing device 1 in contact with the machining target surface S of the workpiece W moves to the outside of the workpiece W.

In other words, as illustrated in FIG. 4, when the polishing device 1 descends from the machining target surface S of the workpiece W, the load exerted on the polishing tool 3 from the workpiece W decreases sharply as the grinding element bundle 14 passes through the edge of the workpiece W. Thus, when the grinding element bundle 14 passes through the edge of the workpiece W, the amount of change in load sharply increases. Here, the amount of change in load that sharply decreases when the polishing device 1 descends from the workpiece W can be determined in advance by experiment or the like. Thus, a predetermined range including the amount of change determined by testing or the like is set as the amount of change threshold range V and stored and retained in the storage unit 52, so that the control unit 51 can determine that the polishing device 1 is descending from the machining target surface S of the workpiece W if the amount of change in load is within the amount of change threshold range V. Accordingly, even when the load falls outside the load threshold range R, if the amount of change is within the amount of change threshold range V (step ST22, Yes at step ST23), the control unit 51 does not perform the projection control operation (step ST25), thereby preventing unnecessary projection control operation from being performed when the polishing device 1 is descending from the machining target surface S of the workpiece W.

On the other hand, if the load falls outside the load threshold range R and the amount of change is outside the amount of change threshold range V (step ST22, No at step ST23), the control unit 51 performs the projection control operation. "The amount of change is outside the amount of change threshold range V when the load falls outside the load threshold range R" refers to, for example, a case where movement control to reduce the speed of moving the polishing device 1 is being performed on the machine tool M side when the machine tool M brings the polishing device 1 down from the workpiece W. In such a case, the projection control operation can be performed to advance the polishing tool 3 and ensure that the grinding element bundle 14 comes into contact with the edge of the workpiece W. Further, "the amount of change is outside the amount of change threshold range V when the load falls outside the load threshold range R" refers to, for example, a case where movement control to gently move the polishing device 1 in a direction away from the machining target surface S is being performed on the machine tool M side when the machine tool M brings the polishing device 1 down from the workpiece W. In such a case, the projection control operation can be performed to advance the polishing tool 3 and ensure that the grinding element bundle 14 comes into contact with the edge of the workpiece W. In both cases, when the polishing device 1 descends from the workpiece W, the load becomes zero. The projection control operation therefore stops at the point of time when the load becomes zero.

Further, as illustrated in FIG. 10, the control unit 51 monitors the load and successively calculates the amount of change (step ST31), and when the load falls outside the load threshold range R and the amount of change becomes equal to or greater than the amount of change threshold Q (step ST32), the control unit 51 sets a state of not performing the projection control operation, and counts, with the timer 53, the duration time of a state in which the load is outside the threshold range and the amount of change is equal to or greater than the amount of change threshold Q (step ST33). Then, the control unit 51 keeps the state of not performing the projection control operation until the duration time from the point of time when the load falls outside the load threshold range R and the amount of change becomes equal to or greater than the amount of change threshold Q reaches a predetermined set time, and resumes the projection control operation when the duration time exceeds the set time (Yes at step ST34, step ST35). On the other hand, if the duration time does not exceed the set time, the control unit 51 does not perform the projection control operation (No at step ST34, step ST36). As illustrated in the upper section of FIG. 11, such control is performed in a case where the machining path E along which the polishing device 1 passes through the workpiece W has a section K4 having notches L or depressions, in order to avoid unnecessary projection control operation during passage through these notches L or depressions.

In other words, in a case where the machining target surface S of the workpiece W has notches L or depressions, the contact area in which the polishing tool 3 (grinding element bundle 14) comes into contact with the workpiece W decreases sharply when the polishing device 1 passes through the notches L or depressions. As a result, as illustrated in the lower section of FIG. 11, the load exerted on the polishing tool 3 from the workpiece W decreases sharply and falls outside the load threshold range R. In addition, as the load decreases sharply, the amount of change in load increases sharply, compared with the amount of change in load caused by wear of the grinding element bundle 14. The control unit 51 therefore can determine that the machining target surface S of the workpiece W has notches L or depressions when the load falls outside the load threshold range R and the amount of change becomes equal to or greater than the amount of change threshold Q ($|dP'/dt|$). In other words, when the load falls outside the load threshold range R and the amount of change becomes equal to or greater than the amount of change threshold Q, the control unit 51 can determine that the load falls outside the load threshold range R due to the shape of the machining target surface S, rather than determining that the load falls outside the load threshold range R due to wear of the grinding element bundle 14. The control unit 51 therefore sets a state of not performing the projection control operation when the load falls outside the load threshold range R and the amount of change becomes equal to or greater than the amount of change threshold Q. This prevents the grinding element bundle 14 from sticking out when the polishing device 1 faces notches L or depressions.

Further, after stopping the projection control operation, the control unit 51 counts, with the timer 53, the duration time of the state in which the load is outside the threshold range and the amount of change is equal to or greater than the amount of change threshold Q, and keeps the state of not performing the projection control operation until the duration time reaches a predetermined set duration time. Thus, the set time is set to an appropriate value in advance so that the projection control operation is not performed while the polishing device 1 passes through notches L or depressions. This prevents the grinding element bundle 14 from sticking out while the polishing device 1 passes through notches L or depressions.

(Projection Control Operation Performed while Polishing Device Moves Along Machining Path)

As illustrated in FIG. 4, the machining path E along which the machine tool M moves the polishing device 1 may be set such that the polishing device 1 starts in front of the workpiece W, passes through the workpiece W, and reaches deeper than the workpiece W. The polishing tool holder 4 monitors the output from the load detector 23 and successively calculates the amount of change in load while the polishing device 1 moves along the machining path E, and performs the projection control operation of controlling the driving of the drive source (motor 35) based on the load and the amount of change to advance or retract the polishing tool 3.

As illustrated in FIG. 4, in the section K2 in which the polishing device 1 is positioned in front of the workpiece W, the output from the load detector 23 is zero until the polishing tool 3 comes into contact with the workpiece W. The control unit 51 therefore stops the projection control operation. The control unit 51 keeps the state of not performing the projection control operation until the amount of change falls below the set amount of change U after the projection control operation is stopped, and sets a state of being ready for the projection control operation after the amount of change falls below the set amount of change U. As a result, when riding up on the workpiece W, the polishing device 1 is in a state of not performing the projection control operation until the polishing device 1 rides up on the workpiece W, and comes into a state of being ready for the projection control operation after the polishing device 1 rides up on the workpiece W.

Next, in the section K1 in which the polishing device 1 passes through the polishing target surface S of the workpiece W, as illustrated in FIG. 7, the polishing device 1 performs the projection control operation when the load is outside the load threshold range R and the amount of change is smaller than the amount of change threshold Q. In other words, the polishing device 1 performs the projection control operation when the polishing tool 3 is polishing the machining target surface S of the workpiece W and the load is changing due to wear of the grinding element bundle 14 by polishing.

In the projection control operation, the polishing device 1 drives the motor 35 to move the attachment part 21 to the front side X2 when the output from the load detector 23 becomes lower than the first threshold R1. The polishing device 1 monitors the output (load) from the motor 35 when driving the motor 35 to move the attachment part 21, and when the load reaches the second threshold R2, the polishing device 1 stops driving the motor 35 to stop moving the attachment part 21. With this operation, the polishing tool 3 advances when the grinding element bundle 14 wears and the depth of cut decreases, thereby ensuring the depth of cut.

In the projection control operation, the control unit 51 drives the motor 35 to move the attachment part 21 to the back side X1 when the output from the load detector 23 exceeds the predetermined second threshold R2. Further, the control unit 51 monitors the output (load) from the motor 35 when driving the motor 35 to move the attachment part 21, and stops driving the motor 35 to stop moving the attachment part 21 when the load returns to the second threshold R2. Here, "the output from the load detector 23 exceeds the predetermined second threshold R2" refers to a case where the distance between the spindle N of the machine tool M and the machining target surface S of the workpiece W becomes shorter than the intended distance due to a dimensional deviation of the workpiece W or the like, and the depth of cut of the workpiece W by the grinding element bundle 142 increases beyond an appropriate range. In such a case, the control unit 51 drives the motor 35 to move the attachment part 21 to the back side X1, so that the polishing tool 3 moves in a direction away from the workpiece W. Thus, the depth of cut by the grinding element bundle 14 is reduced to keep the machining accuracy of the polishing device 1 on the workpiece W.

Further, as illustrated in FIG. 4, in the section K4 in which the polishing device 1 passes through the polishing target surface S of the workpiece W, the control unit 51 sets a state of not performing the projection control operation when the load falls outside the load threshold range R and the amount of change becomes equal to or greater than the amount of change threshold Q, and counts the duration time of the state in which the load is outside the load threshold range R and the amount of change is equal to or greater than the amount of change threshold Q, and keeps the state of not performing the projection control operation until the duration time reaches a predetermined set duration time. Then, the control unit 51 sets a state of being ready for the projection control operation when the duration time exceeds the set duration time. Thus, when the machining path E has notches L as illustrated in FIG. 11, unnecessary projection control operation does not have to be performed during passage through these notches L.

Subsequently, as illustrated in FIG. 4, in a section K3 in which the polishing device 1 descends from the machining target surface S of the workpiece W and reaches deeper than the workpiece W, the polishing device 1 does not perform the projection control operation if the load is outside the load threshold range R and the amount of change is within the predetermined amount of change threshold range V. In other words, if the amount of change is within the preset amount of change threshold range V, the polishing device 1 determines that the decrease in load is caused not by wear of the grinding element bundle 14 but by descending of the polishing device 1 from the workpiece W, and does not perform the projection control operation. As a result, when the polishing device 1 descends from the workpiece W, unnecessary projection control operation can be avoided.

In the section K3 in which the polishing device 1 descends from the machining target surface S of the workpiece W and reaches deeper than the workpiece W, the projection control operation is performed if the amount of change is outside the amount of change threshold range V when the load is outside the load threshold range R. Such a state occurs, for example, when special movement control on the polishing device 1 is performed on the machine tool M side. In such a case, the control unit 51 performs the projection control operation, so that the polishing tool 3 can be advanced to ensure that the grinding element bundle 14 comes into contact with the edge of the workpiece W.

Here, when the polishing device 1 completely descends from the workpiece W, the load becomes zero. The projection control operation therefore stops at the point of time when the load becomes zero.

(Operation Effects)

According to the present example, the polishing tool holder 4 can determine whether the polishing tool 3 is in contact with the machining target surface S of the workpiece W based on the amount of change in load. Thus, the projection control operation is performed based on the load and the amount of change in load, so that the polishing device 1 can perform the projection control operation to allow the polishing tool 3 to stick out toward the workpiece W only when the polishing tool 3 is in contact with the machining target surface S of the workpiece W.

(First Modification)

Figure 12:
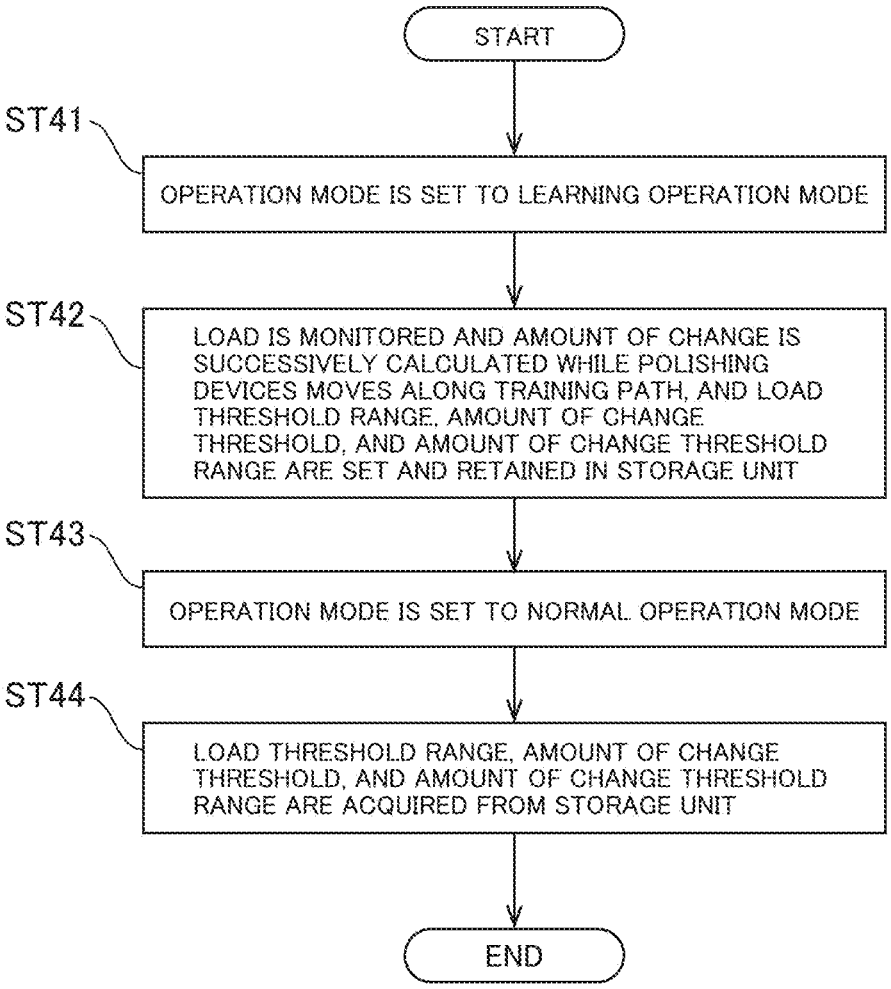
FIG. 12 is a flowchart of the projection control operation of the polishing device in a modification.

FIG. 12 is a flowchart of the projection control operation of the polishing device 1 in a first modification. The polishing device 1 may have, as operation modes of the control unit 51, a normal operation mode of performing the machining operation as described above and a learning operation mode for setting the load threshold range R and the amount of change threshold Q.

In this case, as indicated by a dotted line in FIG. 5, the control unit 51 includes an operation mode switching unit 60 that switches the operation mode of the control unit 51 between the normal operation mode and the learning operation mode. In this case, the control unit 51 also includes a training data setting unit 61 that sets the load threshold range R, the amount of change threshold Q, and the amount of change threshold range V from the trained data and stores and retains the same in the storage unit 52, in the learning operation mode.

In the present example, as illustrated in FIG. 12, in order to set the load threshold range R and the amount of change threshold Q, the operation mode of the control unit 51 is first set to the learning operation mode (step ST41). Next, the shaft of the polishing device 1 is connected to the spindle N of the machine tool M and the machine tool M is operated to move the polishing device 1 along a predetermined training path. The training path includes a machining path portion (section K1 in FIG. 4) in which a flat machining target surface S of the workpiece W is polished by the polishing device 1, and a machining exit path portion (section K3 in FIG. 4) in which the polishing device 1 is brought down from the machining target surface S and separated from the workpiece W. In the machining path portion (section K1), the distance between the spindle N of the machine tool M and the machining target surface S is kept constant when the polishing tool 3 faces the machining target surface S of the workpiece W. In the machining path portion (section K1), the grinding element bundle 14 is kept in contact with the surface of the workpiece W.

Here, when the polishing device 1 passes through the machining path portion (section K1), the training data setting unit 61 monitors the output from the load detector 23 and successively calculates the amount of change in load per predetermined unit time, sets the load threshold range R based on the load and sets the amount of change threshold Q based on the amount of change, and stores and retains the set load threshold range R and amount of change threshold Q in the storage unit 52 (step ST42).

In other words, the training data setting unit 61 determines a first threshold R1 which is the lower limit of load that can ensure a depth of cut suitable for polishing the workpiece W and a second threshold R2 which is the upper limit of load, based on the load output from the load detector 23 when the polishing tool 3 polishes the flat machining target surface S, and sets the range between these values as the load threshold range R. To set the load threshold range R based on the load detected in the learning operation mode, data in a table format that associates the load with the amount of change threshold range V and a formula that represents the relation between the load and the amount of change threshold range V are stored and retained in the storage unit 52 in advance. The training data setting unit 61 automatically calculates the load threshold range R from the load using these data and formula. The training data setting unit 61 stores and retains the calculated load threshold range R in the storage unit 52.

Further, the training data setting unit 61 sets the lower limit of the amount of change that can be estimated to be caused by wear of the grinding element bundle 14, as the amount of change threshold Q, based on the amount of change in load output from the load detector 23 when the polishing tool 3 polishes the flat machining target surface S. To set the amount of change threshold Q based on the amount of change calculated in the learning operation mode, data in a table format that associates the amount of change with the amount of change threshold Q and a formula that represents the relation between the amount of change and the amount of change threshold Q are stored and retained in advance in the storage unit 52. The training data setting unit 61 automatically calculates the amount of change threshold Q from the amount of change using these data and formula. The training data setting unit 61 stores and retains the calculated amount of change threshold Q in the storage unit 52 (step ST42).

Further, when the polishing device 1 passes through the machining exit path portion, the training data setting unit 61 of the control unit 51 monitors the output from the load detector 23 and successively calculates the amount of change in load per predetermined unit time, and sets the amount of change threshold range V based on the load. In other words, the training data setting unit 61 acquires the amount of change in load when the polishing tool 3 descends from the flat machining target surface S and sets the range including this amount of change as the amount of change threshold range V. To set the amount of change threshold range V based on the acquired amount of change, data in a table format that associates the amount of change with the amount of change threshold range V and a formula of the relation between the amount of change and the amount of change threshold range V are stored and retained in the storage unit 52 in advance. The training data setting unit 61 automatically calculates the amount of change threshold range V from the amount of change using these data and formula. The training data setting unit 61 stores and retains the calculated amount of change threshold range V in the storage unit 52 (step ST42).

When the polishing device 1 is to be moved along the machining path E by the machine tool M, the operation mode of the control unit 51 is switched from the learning operation mode to the normal operation mode (step ST43). In the normal operating mode, the control unit 51 refers to the storage unit 52 and acquires the load threshold range R, the amount of change threshold Q, and the amount of change threshold range V (step ST44).

In the present example, the workpiece W is machined with the polishing device 1 in the learning operation mode as the operation mode of the control unit 51, whereby the load threshold range R, the amount of change threshold Q, and the amount of change range required for the projection control operation of the control unit 51 can be set.

(Second Modification)

Figure 13:
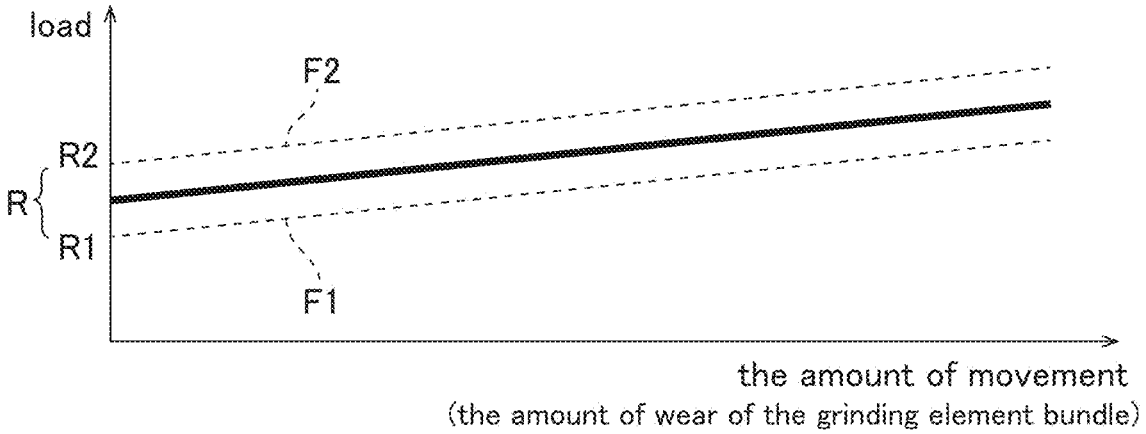
FIG. 13 is an illustration of a load threshold range in a case where the load threshold range is changed based on the length dimension of a grinding element bundle.

The polishing tool holder 4 may change the load threshold range R for performing the projection control operation during the machining operation. In a second modification, the load threshold range R is changed based on the length dimension of the grinding element bundle 14. FIG. 13 is an illustration of the load threshold range R in a case where the load threshold range R is changed based on the length dimension of the grinding element bundle 14.

In this case, the polishing device 1 retains a plurality of load threshold ranges R associated with the length dimension of the grinding element bundle 14 in the axis L direction as the load threshold range R in advance in the storage unit 52 (load threshold storage unit). In the present example, as illustrated in FIG. 13, as the plurality of load threshold ranges R, a first formula by which a first threshold R1 as the lower limit of the load threshold range R can be calculated based on the length dimension of the grinding element bundle 14 and a second formula by which a second threshold R2 as the upper limit of the load threshold range R can be calculated based on the length dimension of the grinding element bundle 14 are stored and retained in the storage unit 52. In the first formula F1, the first threshold R1 increases as the length dimension of the grinding element bundle 14 decreases. In the second formula F2, the second threshold R2 also increases as the length dimension of the grinding element bundle 14 decreases.

As indicated by a dotted line in FIG. 5, the control unit 51 includes an initial operation control unit 63 that places the attachment part 21 in an initial position to allow advance or retraction in the axis L direction. The control unit 51 further includes a load threshold range resetting unit 64 that calculates the amount of movement of the attachment part 21 moving from the initial position to the side opposite to the shank 6 based on the amount of driving of the motor 35 and the movement direction of the attachment part 21, every time the attachment part 21 is moved in the projection control operation, and refers to the load threshold storage unit 52 based on the amount of movement to select one load threshold range R from among the plurality of load threshold ranges R.

In the present example, before the polishing tool holder 4 is moved along the machining path E by the machine tool M, the attachment part 21 having the polishing tool 3 attached thereto is placed in the initial position to allow advance or retraction in the axis L direction. While the polishing tool holder 4 is moved along the machining path E by the machine tool M, the control unit 51 calculates the amount of movement of the attachment part 21 from the initial position and selects one load threshold range R from among a plurality of load threshold ranges R based on the amount of movement. In other words, the first threshold R1 and the second threshold R2 corresponding to the length dimension of the grinding element bundle 14 are calculated by substituting the calculated amount of movement into each of the first formula F1 and the second formula F2.

Here, the elastic bundle of the grinding element bundle 14 is more flexible with a longer dimension in the axis L direction, and the cutting ability is lower. However, as the amount of wear increases and the length dimension in the axis L direction decreases, the bundle of grinding element bundle 14 becomes more rigid, and the cutting ability increases. The amount of movement of the attachment part 21 moved from the initial position to the side opposite to the shank 6 corresponds to the amount of wear of the grinding element bundle 14. The length dimension of the grinding element bundle 14 therefore can be easily determined based on the amount of movement. Thus, the load threshold range R is obtained by substituting the amount of movement (the amount of wear of the grinding element bundle 14) into the first formula F1 and the second formula F2, so that the load threshold range R can be brought to higher values when the grinding element bundle 14 becomes shorter, whereby the cutting ability of the grinding element bundle 14 can be kept constant. As a result, according to the present example, the bundle cutting ability of the grinding element bundle 14 can be kept constant regardless of the bundle length dimension of the grinding element bundle 14.

(Third Modification)

As another example of changing the load threshold range R for performing the projection control operation during machining operation, the polishing tool holder 4 may change the load threshold range R for performing the projection control operation before and after the load output from the load detector 23 becomes zero. The point of time when the load becomes zero is the point of time when the polishing device 1 descends from the workpiece W in the middle of the machining path E.

Figure 14:
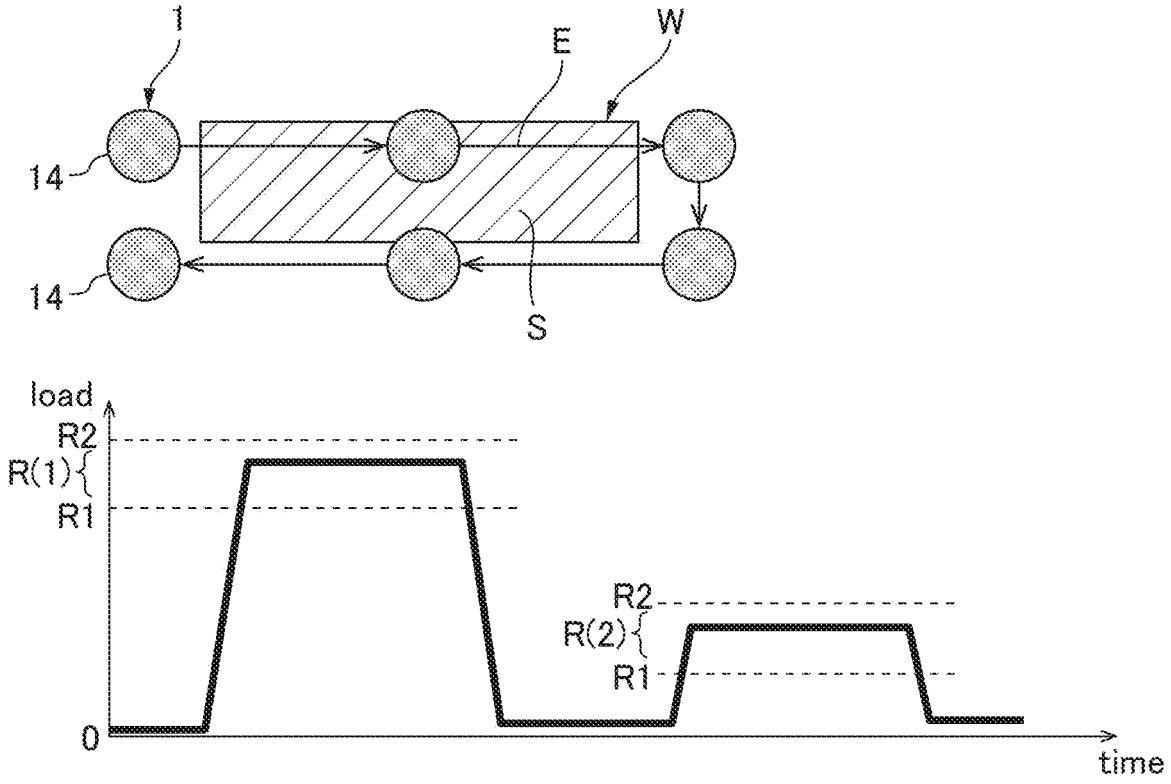
FIG. 14 is an illustration in a case where the load threshold range is changed when the polishing device rides up on and descends from the workpiece.
Figure 15:
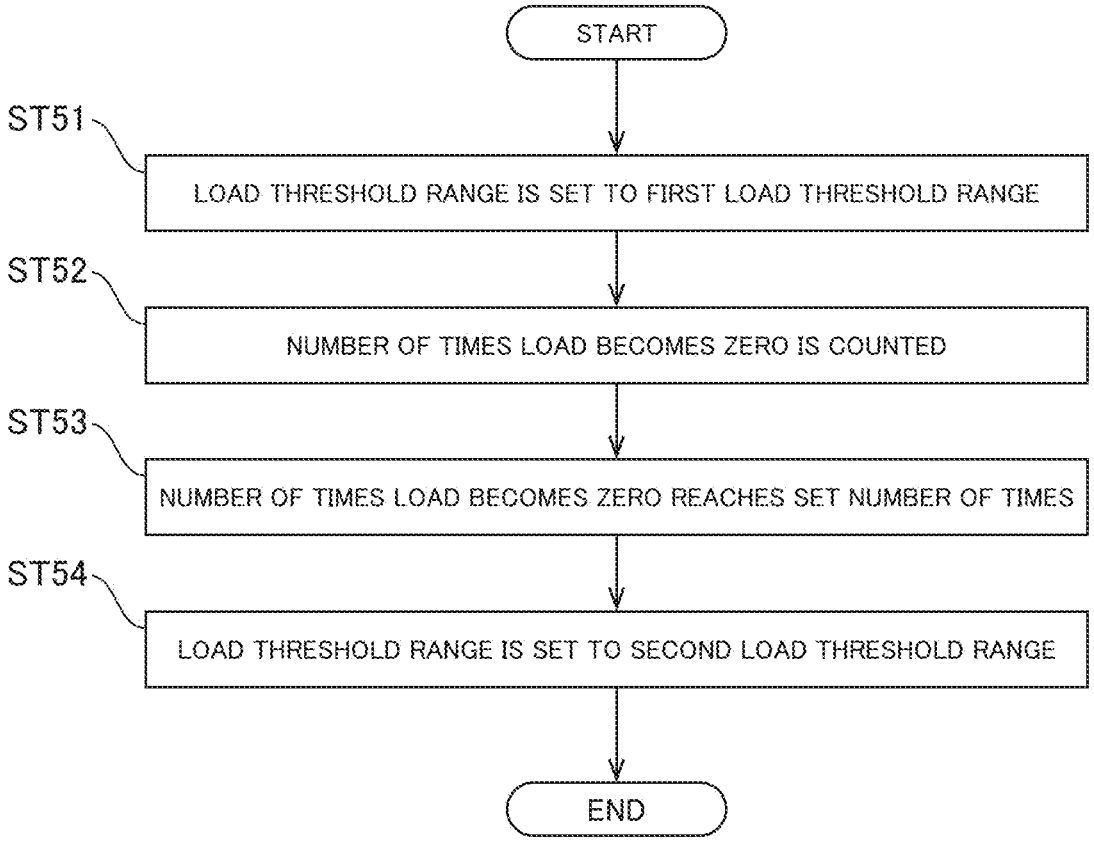
FIG. 15 is a flowchart of the projection control operation performed when the polishing device rides up on and descends from the workpiece.

FIG. 14 is an illustration in a case where the load threshold range R is changed when the polishing device 1 rides up on and descends from the workpiece W. The upper section of FIG. 14 illustrates the positional relation between the polishing device 1 and the workpiece W. The lower section of FIG. 14 is a graph of the load exerted on the polishing tool 3 from the workpiece W and the load threshold range. FIG. 15 is a flowchart of the projection control operation performed when the polishing device rides up on and descends from the workpiece.

As illustrated in the upper section of FIG. 14, in the present example, the polishing device 1 machines the workpiece W with 80% of the grinding element bundle 4 in abutment with the machining target surface S until the polishing device 1 descends from the workpiece W for the first time after riding up on the workpiece W. The polishing device 1 then machines the workpiece W with 20% of the grinding element bundle 4 in abutment with the machining target surface S until the polishing device 1 rides up on and descends from the workpiece W next time.

In this case, the storage unit 52 retains a first load threshold range R(1) and a second load threshold range R(2) different from the first load threshold range R(1), as the load threshold range R. In the present example, the range of the second load threshold range R(2) has values smaller than that of the first load threshold range R(1). As indicated by a dotted line in FIG. 5, the control unit 51 includes a counting unit 65 that counts the number of times the load becomes zero, and a load threshold range resetting unit 64 that sets the first load threshold range R as the load threshold range R until the number of times reaches a predetermined set number of times and sets the load threshold range R to the second load threshold range R when the number of times reaches the set number of times.

In this way, in the projection control operation performed at the start of machining, the control unit 51 controls the driving of the motor 35 based on whether the load is within the first load threshold range R(1) (step ST51). Then, the number of times the load becomes zero is counted (step ST52), and after the number of times the load becomes zero reaches the set number of times (once in this example) (step ST53), the control unit 51 controls the driving of the motor 35, based on whether the load is within the second load threshold range R (step ST54). Thus, in a case where the polishing device 1 moving along the machining path E repeatedly rides up on and descends from the machining target surface S of the workpiece W, the depth of cut of the workpiece W by the grinding element bundle 14 can be adjusted at the point of time when the polishing device 1 rides up on the workpiece W after riding up and descending the set number of times.

Other Embodiments

Figure 16:
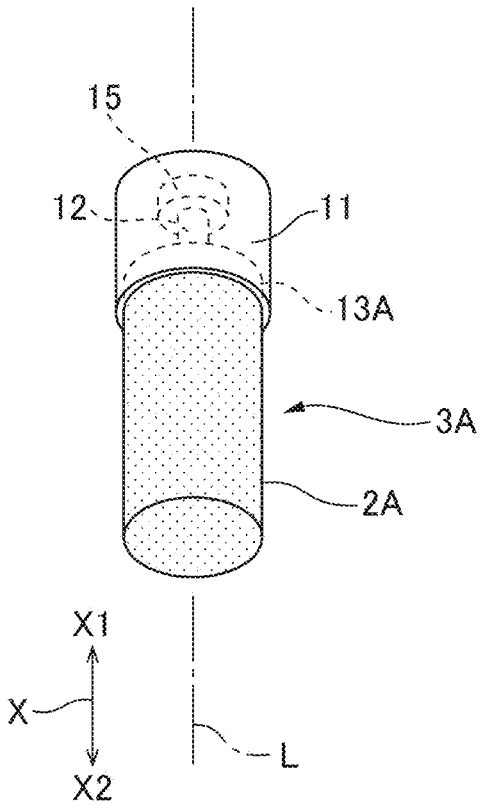
FIG. 16 is a perspective view of the polishing tool having an elastic grinder as the grinding element.

The polishing tool 3 of the polishing device 1 may include an elastic grinder as the grinding element. FIG. 16 is a perspective view of another polishing tool of the polishing device. A polishing tool 3A illustrated in FIG. 16 includes a cylindrical elastic grinder 2A extending in the axial direction X as the grinding element. The polishing tool 3A also includes a grinding element holder for holding the elastic grinder 2A. The shape of the elastic grinder 2A may be prismatic.

The elastic grinder 2A includes an elastic foam, a polymer, and abrasive grains. The elastic foam is, for example, a melamine resin foam. The elastic foam may be an anisotropic elastic foam that is compressed in one direction to impart anisotropy to elastic force. The polymer is one of epoxy-based resins, urethane-based resins, polyester-based resins, or polyrotaxane. The abrasive grains are selected as appropriate depending on the kind of workpiece W. Diamond, alumina, silica, silicon carbide, silicon nitride, boron carbide, titania, cerium oxide, or zirconia can be used as the abrasive grains. The base material of such elastic grinder is obtained by sintering the anisotropic elastic foam impregnated with a dispersion liquid containing a polymer and abrasive grains. The direction with the strongest elastic force in the anisotropic elastic foam is the compression direction.

The grinding element holder 11 is an annular member having a holder through hole 12 extending in the axial direction X at the center. The grinding element holder 11 has a circular grinding element-holding recess 13A on its front end surface. The grinding element holder 11 holds one end in the axial direction X of the elastic grinder 2A. The grinding element holder 11 has a recess surrounding the holder through hole 12 at its back end surface. The recess is a polishing tool-side joint portion for removably attaching the polishing tool 3 to the polishing tool holder 4. The polishing tool 3A is held in the polishing tool holder 4 to form the polishing device 1.

Here, when the grinding element is the elastic grinder 2A, the grinding element is more flexible with a longer dimension in the axial direction X, and the cutting ability is lower. However, as the amount of wear increases and the length dimension in the axial direction of the grinding element decreases, the rigidity increases and the cutting ability increases. When the grinding element is the elastic grinder 2A, the load output from the load detector 23 is the reaction force that pushes the front end surface of the elastic grinder 2A vertically from the machining target surface S of the workpiece W during polishing. Such reaction force is proportional to the contact area in which the front end surface of the elastic grinder 2A is in contact with the machining target surface S of the workpiece W. Thus, when the contact area is smaller, the load decreases, and when the contact area is larger, the load increases. Accordingly, even when the grinding element is the elastic grinder 2A, the present invention can be applied in the same manner as when the grinding element is a bundle of wire-shaped grinding elements 2.

Figure 17:
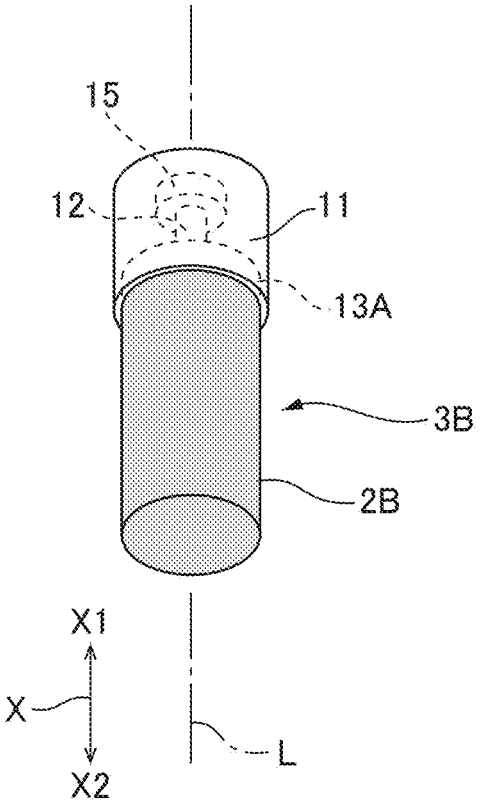
FIG. 17 is a perspective view of the polishing tool having a rigid grinder as the grinding element.

The polishing tool 3 of the polishing device 1 may include a rigid grinder as the grinding element. FIG. 17 is a perspective view of another polishing tool of the polishing device. A polishing tool 3B illustrated in FIG. 17 includes a rigid grinder 2B extending in the axial direction X as the grinding element. The polishing tool 3B also includes a grinding element holder 11 for holding the grinder 2B. The grinding element holder 11 is the same as the grinding element holder 11 of the polishing tool 3A illustrated in FIG. 16.

Here, since the rigid grinder 2B has a large Young's modulus, deflection of the grinder 2B itself presumably does not occur. When the grinding element is the grinder 2B, variations in cutting ability due to the dimension in the axial direction X presumably do not occur. However, in the polishing device 1, it is necessary to bring the front end surface of the grinder 2B into contact with the machining target surface S of the workpiece W. The grinder 2B is therefore held in the grinding element holder 11 in a cantilevered state. Similarly, the grinder 2B is held in the polishing tool holder 4 in a cantilevered state with the grinding element holder 11 interposed. Thus, deflection under cantilever distal end-intensive load occurs in the grinder 2B.

The amount of deflection caused by the cantilever distal end-intensive load is proportional to the third power of the length dimension in the axial direction X. Therefore, the longer the dimension in the axial direction X, the greater the amount of deflection, and the cutting ability tends to decrease. On the other hand, as the amount of wear increases and the length dimension in the axial direction of the grinding element decreases, the amount of deflection decreases, and therefore the rigidity increases and the cutting ability increases. When the grinding element is the grinder 2B, the load output from the load detector 23 is the reaction force that pushes the front end surface of the grinder 2B vertically from the machining target surface S of the workpiece W during polishing. Such reaction force is proportional to the contact area in which the front end surface of the grinder 2B is in contact with the machining target surface S of the workpiece W. Thus, when the contact area is smaller, the load decreases, and when the contact area is larger, the load increases. Accordingly, even when the grinding element is the rigid grinder 2B, the present invention can be applied in the same manner as when the grinding element is a bundle of wire-shaped grinding elements 2.

The rigid grinder 2B is more likely to be cracked with a longer dimension in the axial direction X, compared with an elastic grinding element. To address this problem, the load threshold range is changed based on the length dimension in the axial direction X of the grinder 2B to suppress cracking of the grinder 2B.

The invention claimed is:

1. A method of controlling a polishing tool holder that includes a machine attachment part, an attachment part to which a polishing tool is attached, a movement mechanism including a drive source configured to move the attachment part in an axial direction of the machine attachment part, and a load detector configured to detect a load exerted on the polishing tool attached to the attachment part, the method comprising attaching a polishing tool having a grinding element to the attachment part, connecting the machine attachment part to a spindle of a machine tool and operating the machine tool, monitoring an output from the load detector and calculating an amount of change of the load per unit time while the machine tool moves the polishing tool holder along a predetermined machining path, and performing a projection control operation, the projection control operation comprising driving the drive source based on the load detected by the load detector and the amount of change of the load per unit time, and moving the attachment part to advance or retract the polishing tool, wherein when the load detected by the load detector is outside a preset load threshold range and the amount of change of the load per unit time is smaller than a preset amount of change threshold, the projection control operation is performed.

2. The method of controlling a polishing tool holder according to claim 1, wherein the projection control operation is stopped when the load detected by the load detector is zero, and a state of not performing the projection control operation is kept until the amount of change of the detected load exerted on the polishing tool per unit time falls below a preset set amount of change.

3. The method of controlling a polishing tool holder according to claim 1, wherein when the load detected by the load detector is outside the load threshold range and the amount of change of the load per unit time is within a predetermined amount of change threshold range, a state of not performing the projection control operation is set, and when the load detected by the load detector is outside the load threshold range and the amount of change of the load per unit time is outside the amount of change threshold range, the projection control operation is performed.

4. The method of controlling a polishing tool holder according to claim 1, wherein when the load detected by the load detector falls outside the load threshold range and the amount of change of the load per unit time becomes equal to or greater than the amount of change threshold, a state of not performing the projection control operation is set, a duration time of a state in which the load detected by the load detector is outside the load threshold range and the amount of change of the load per unit time is equal to or greater than the amount of change threshold is counted, the state of not performing the projection control operation is kept until the duration time reaches a predetermined set time, and when the duration time exceeds the set time, the projection control operation is resumed.

5. The method of controlling a polishing tool holder according to claim 1, wherein a plurality of the load threshold ranges associated with a length dimension of the grinding element in the axial direction are retained in advance as the load threshold range, the attachment part having the polishing tool attached is placed in an initial position to allow advance or retraction in the axial direction before the polishing tool holder is moved by the machine tool, and every time the attachment part is moved in the projection control operation, an amount of movement of the attachment part moving from the initial position to a side opposite to the machine attachment part is calculated based on an amount of driving of the drive source and a movement direction of the attachment part, and one load threshold range is selected from among the load threshold ranges based on the amount of movement.

6. The method of controlling a polishing tool holder according to claim 1, wherein a first load threshold range and a second load threshold range different from the first load threshold range are retained in advance as the load threshold range, and the first load threshold range is set as the load threshold range, a number of times the load detected by the load detector becomes zero is counted, and when the number of times reaches a predetermined set number of times, the load threshold range is set to the second load threshold range.

7. The method of controlling a polishing tool holder according to claim 1, wherein a storage unit is provided, the polishing tool holder is moved along a predetermined training path by the machine tool, an output from the load detector is monitored and an amount of change of the load per unit time is successively calculated, the load threshold range is set based on the load detected by the load detector, the amount of change threshold is set based on the amount of change of the load per unit time, and the set load threshold range and the set amount of change threshold are stored and retained in the storage unit, and when the machine tool moves the polishing tool holder along the machining path, the storage unit is referred to and the load threshold range and the amount of change threshold are acquired.

8. The method of controlling a polishing tool holder according to claim 1, wherein the polishing tool has a grinding element with a length direction oriented in the axial direction and a grinding element holder holding one end in the axial direction of the grinding element, and the grinding element holder is attached to the attachment part.

9. A polishing tool holder comprising:

a machine attachment part;

an attachment part to which a polishing tool having a grinding element is attached;

a movement mechanism including a drive source configured to move the attachment part in an axial direction of the machine attachment part;

a load detector configured to detect a load exerted on the polishing tool attached to the attachment part; and a control unit configured to monitor an output from the load detector and calculate an amount of change of the load per unit time, and perform a projection control operation, the projection control operation comprising driving the drive source based on the load detected by the load detector and the amount of change of the load per unit time, and moving the attachment part to advance or retract the polishing tool.

10. The polishing tool holder according to claim 9, wherein the control unit is configured to perform the projection control operation when the load detected by the load detector is outside a preset load threshold range and the amount of change of the load per unit time is smaller than a preset amount of change threshold.

11. The polishing tool holder according to claim 10, wherein when the load detected by the load detector is outside the load threshold range and the amount of change of the load per unit time is within a predetermined amount of change threshold range, the control unit is configured to set a state of not performing the projection control operation, and when the load detected by the load detector is outside the load threshold range and the amount of change of the load per unit time is outside the amount of change threshold range, the control unit is further configured to perform the projection control operation.

12. The polishing tool holder according to claim 10, further comprising a timer, wherein when the load detected by the load detector falls outside the load threshold range and the amount of change of the load per unit time becomes equal to or greater than the amount of change threshold, the control unit is configured to set a state of not performing the projection control operation, to drive the timer to count a duration time of a state in which the load detected by the load detector is outside the load threshold range and the amount of change of the load per unit time is equal to or greater than the amount of change threshold, to keep the state of not performing the projection control operation until the duration time reaches a predetermined set time, and to resume the projection control operation when the duration time exceeds the set time.

13. The polishing tool holder according to claim 10, further comprising a load threshold storage unit configured to store and retain a plurality of load threshold ranges associated with a length dimension of the grinding element in the axial direction as the load threshold range, wherein the control unit includes an initial operation control unit configured to place the attachment part in an initial position to allow advance or retraction in the axial direction, and a load threshold range resetting unit configured to calculate an amount of movement of the attachment part moving from the initial position to a side opposite to the machine attachment part, based on an amount of driving of the drive source and a movement direction of the attachment part, every time the attachment part is moved in the projection control operation, and refer to the load threshold storage unit based on the amount of movement and select one load threshold range from among the load threshold ranges.

14. The polishing tool holder according to claim 10, further comprising a load threshold storage unit configured to store and retain a first load threshold range and a second load threshold range different from the first load threshold range as the load threshold range, wherein the control unit includes a counting unit configured to count a number of times the load detected by the load detector becomes zero, and a load threshold range resetting unit configured to set the first load threshold range as the load threshold range until the number of times reaches a predetermined set number of times, and set the load threshold range to the second load threshold range when the number of times reaches the set number of times.

15. The polishing tool holder according to claim 10, further comprising a storage unit, wherein the control unit includes an operation mode switching unit configured to switch an operation mode of the control unit between a normal operation mode and a learning operation mode, and a training data setting unit configured to monitor an output from the load detector and successively calculate an amount of change of the load per unit time, set the load threshold range based on the load detected by the load detector and set the amount of change threshold based on the amount of change of the load per unit time, and store and retain the set load threshold range and the set amount of change threshold in the storage unit, in the learning operation mode, and the control unit refers to the storage unit and acquires the load threshold range and the amount of change threshold from the storage unit in the normal operation mode.

16. The polishing tool holder according to claim 9, wherein the control unit is configured to stop the projection control operation when the load detected by the load detector is zero, and to keep a state of not performing the projection control operation until the amount of change of the load per unit time falls below a preset set amount of change.

17. A polishing device comprising:

the polishing tool holder according to claim 10; and a polishing tool removably attached to the attachment part of the polishing tool holder, wherein the polishing tool includes a grinding element with a length direction oriented in the axial direction and a grinding element holder holding one end in the axial direction of the grinding element, and the grinding element holder is attached to the attachment part.

18. A method of controlling a polishing tool holder that includes a machine attachment part, an attachment part to which a polishing tool is attached, a movement mechanism including a drive source configured to move the attachment part in an axial direction of the machine attachment part, and a load detector configured to detect a load exerted on the polishing tool attached to the attachment part, the method comprising attaching a polishing tool having a grinding element to the attachment part, connecting the machine attachment part to a spindle of a machine tool and operating the machine tool, monitoring an output from the load detector and calculating an amount of change of the load per unit time while the machine tool moves the polishing tool holder along a predetermined machining path, and performing a projection control operation, the projection control operation comprising driving the drive source based on the load detected by the load detector and the amount of change of the load per unit time, and moving the attachment part to advance or retract the polishing tool.

* * * * *